United States Patent [19]

Frickland et al.

[11] Patent Number: 4,980,936

[45] Date of Patent: Jan. 1, 1991

[54] CLOSED CELL FOAM GROUND PAD AND METHODS FOR MAKING SAME

[76] Inventors: Peter O. Frickland, 2006 228th Place NE., Redmond, Wash. 98053; James M. Lea, 1207 NW. Culbertson Dr., Seattle, Wash. 98177; Peter D. Haggerty, 3233 23rd Ave. W., Seattle, Wash. 98199; Eric L. Rayl, 7625 S. Laurel, Seattle, Wash. 98178; John D. Burroughs, 10468 Forest Ave. S., Seattle, Wash. 98178

[21] Appl. No.: 92,690

[22] Filed: Sep. 3, 1987

Related U.S. Application Data

[63] Continuation-in-part of Ser. No. 904,054, Sep. 5, 1986, abandoned.

[51] Int. Cl.[5] ..... A47G 9/00

[52] U.S. Cl. ..... 5/420; 5/481

[58] Field of Search ..... 264/126, 288.8, 163, 264/291, DIG. 73; 5/420, 481; 297/DIG. 1, 457; 108/51–58, 34, 38, 67, 68

[56] References Cited

U.S. PATENT DOCUMENTS

| | | | |
|---|---|---|---|
| 3,384,108 | 6/1971 | Nelson | 264/288.8 |
| 3,889,032 | 6/1975 | Koelsen | 264/126 |
| 4,450,193 | 5/1984 | Staebler | 428/906 |
| 4,686,724 | 8/1987 | Bedford | 5/481 |

FOREIGN PATENT DOCUMENTS

| | | | |
|---|---|---|---|
| 241050 | 6/1965 | Austria | 5/481 |
| 526407 | 5/1955 | Italy | 5/481 |
| 307755 | 3/1929 | United Kingdom | 5/481 |
| 434550 | 7/1935 | United Kingdom | 5/481 |
| 804093 | 11/1958 | United Kingdom | 5/481 |

*Primary Examiner*—Eric K. Nicholson
*Attorney, Agent, or Firm*—Hughes & Multer

[57] ABSTRACT

A flexible pad is disclosed for supporting a load above an underlying surface. The pad is thermoformed from closed cell material comprising a plurality of closed cells. A substantial portion of the cells are elongated in a direction generally parallel to ribs and velleys formed in the upper and lower surface and lower surfaces of the pad.

68 Claims, 11 Drawing Sheets

CLOSED CELL FOAM GROUND PAD AND METHODS FOR MAKING SAME

This is a continuation-in-part of application Ser. No. 904054, now abandoned.

TECHNICAL FIELD

The present invention pertains to a closed cell foam ground pad which is used to support an individual in a prone or sitting position.

BACKGROUND OF THE INVENTION

Sleeping pads for outdoor use have comfort requirements similar to those of indoor beds and cushions. They also have added requirements for durability and portability. The tradeoffs which exist between these three general requirements and the materials available for construction have determined the evolution and effectiveness of ground pads developed to date.

Lacking significant thickness or weight constraints, most bed mattresses are made of several layers of various foams, textiles and spring assemblies. By varying the compliance and resiliency of each layer, indoor mattresses can be designed to meet virtually all user requirements.

For ground pads, direct use of indoor mattress designs are infeasible due to the requirement that the ground pad be easily transported by the individual. However, a ground pad needs to have enough compliance to feel comfortable, but not so much that the individual user "bottoms out" on the ground. One method of achieving compliance is by increasing the thickness of the pad, but only at the sacrifice of increasing the stored volume and weight.

Ground pads also have special comfort-related requirements which are unique to their use environment. Thermal loss due to conduction, convection and radiation are important factors, especially due to the fact that most ground pads are thinner and rest on colder surfaces than indoor mattresses. Because they are often used in wet environments, resistance to moisture absorption is also a key consideration in the design of a ground pad.

Relatively early, ground pads were made of natural rubber foams, which were both elastic and could be molded to intricate shapes The natural foam rubber ground pad offered new features which were only partially exploited because of the relatively low compliance of natural rubber. However, introduction of latex foam rubber offered a further comfort breakthrough for mattresses because of its softness, resiliency and resistance to fatigue.

The natural rubber and latex foam rubbers, as well as urethane foams, incorporate an open cell structure. That is the rubber is formed by a number of cells which are in communication with each other via openings in the cells. Resistance to compression of these foams is mainly due to the structural support provided by the cellular walls As the open cell foam is compressed, the air within the cells is displaced into the atmosphere.

An open cell structure has several additional disadvantages. First, it promotes the absorption of water from wet supporting surfaces into the structure, much like a household sponge (which is commonly made from an open cell foam material) increasing the pad's weight and promoting moisture transfer to the user's sleeping bag. As a result, many of the open cell foam ground pads have an outer water impervious cover to prevent their water absorption. Second, the open cell structure is also less effective as a thermal insulator due to intercellular openings which facilitate heat transfer. Also, open cell foams allow water vapor to pass through the foam and to condense on an underlying colder surface such as the ground or on the bottom surface of the foam pad, causing the foam to get wet and reduce its insulation value.

A further advance in ground pad design was achieved by the development of several soft, low density, closed cell polymeric foams such as a vinyl-nitrile copolymer known as Ensolite. Reductions in weight and cost of closed cell foam ground pads were achieved through the use of a foamed copolymer of ethylene and vinyl acetate, also known as ethylene-vinyl acetate (EVA). When used as a ground pad material, EVA foam appears to provide the best balance over all other closed cell foams in terms of economy, weight, durability and stored volume.

In addition, not only is the closed cell structure resistant to water absorption, but it also reduces heat loss. This is primarily due to the individual cellular pockets which are essentially sealed and contain therein trapped gases. The presence of the trapped gases, however, tends to make the closed cell pad less compliant than the open cell pad, because the gases must be compressed when the foam is loaded.

A number of support mattresses and pads made of foamed material and the like, have been disclosed. For example, support devices which are configured to be flexible along a specific axis of orientation are disclosed in U.S. Pat. No. 4,370,767 (beach mat) by Fraser; U.S. Pat. No. 4,275,473 (buoyant mattress) by Poirier; and U.S. Pat. No. 4,399,574 by Shuman (foam mattress pad).

Other support apparati which have specific geometries for increasing compliance were disclosed in U.S. Pat. No. 4,110,881 by Thompson, where the surface of a mattress is slotted so it may not be put in tension; U.S. Pat. No. 4,383,342 by Forster, where a plurality of upstanding flexible ribs are tilted at selected angles to achieve a traction force; and U.S. Pat. No. 3,197,357 by Schulpen, where an open cell or closed cell foam pad includes corrugations on at least one surface to increase compressability and compliance. Also disclosed are U.S. Pat. No. 2.194,364 by Minor, which shows a sponge rubber carpet pad which has ridges and valleys which are alleged to entrain air as a cushioning agent; U.S. Pat. No. 2,751,609 by Oesterling, which discloses an insulating pad formed by a plurality of easily compressible blocks secured to a backing sheet; U.S. Pat. No. 3,016,317 by Brunner, which discloses a closed cell resilient mat which has a number of lengthwise and transverse grooves which are made by a thermoforming process; and U.S. Pat. No. 3,814,030 by Morgan, which shows a mesh-like support member which is formed in a corrugated manner by thermoforming, injection molding, extrusion or the like.

In addition to the aforementioned disclosures, a number of multilayered support apparati have been disclosed, such as U.S. Pat. No. 839,834 by Gray (ribbed surfaces oriented at right angles); U.S. Pat. No. 2,953,195 by Turck (opposing sawtooth configured members separated by an inner planar layer); U.S. Pat. No. 4,450,193 by Staebler (mat assembly); U.S. Pat. No. 4.476,594 by McLeod (reversible mattress); and U.S. Pat. No. 4,574,101 (exercise mat containing internal air chambers).

Also disclosed is a support pad having an exterior cover in U.S. Pat. No. 4,329,747 by Russell and an inflatable cushion in U.S. Pat. No. 4,076,872 by Lewicki.

SUMMARY OF THE INVENTION

The product of the present invention comprises a flexible pad for supporting a load (e.g. a person) above an underlying surface, with the pad having an upper surface, a lower surface, a first horizontal axis, a second horizontal axis perpendicular to the first axis, and a vertical axis. The pad is characterized in that it is made in a thermoformed closed cell foam material which comprises a plurality of closed cells. A substantial portion of the cells are elongated in a direction having a substantial alignment component generally parallel to the first axis and also having a substantial alignment component following a contour of at least the upper surface.

At least the upper surface of the pad is formed with a plurality of upwardly extending protrusions, separated by upper recesses positioned between their respective protrusions. Each of the upper protrusions has an upper side surface which slopes upwardly and convergently toward an upper peak area, with opposite surface portions of each of said side surfaces extending upwardly toward one another at a pad angle of between about ten degrees and one hundred and thirty degrees, and with a more preferred range of thirty to ninety degrees, in some configurations a pad angle between about sixty and one hundred and thirty degrees, with a more preferred range between sixty five and one hundred and five degrees and a more preferred range between seventy to ninety degrees.

The pad has a total thickness dimension which is measured from a plane occupied by the upper peak areas to a lower plane defined by the lowermost portions of the lower surface of the pad. The pad also has a peak-to-peak dimension which is equal to a distance between center locations of adjacent peak areas of adjacent upper protrusions. The pad has a total thickness dimension to peak-to-peak ratio of between about 0.4 and 2, with a more preferred range being between about two to three and four to three.

The pad also has a minimum material thickness dimension which is equal to a minimum distance between the upper and lower surfaces The pad has a minimum material thickness dimension to a total thickness dimension ratio which is between about 0.2 and 0.7, with a more preferred range being between about 0.3 and 0.6, and the most preferred range being between about 0.35 and 0.5.

In some embodiments, the protrusions are formed only on the upper surface of the pad, while in other embodiments, the protrusions are formed on upper and lower surfaces of the pad. Further, in some embodiments, the protrusions are formed as elongate ribs, positioned on one or both sides of the pad, while in other embodiments, the protrusions each have a sloping circumferential side surface enclosing that protrusion.

In a preferred form of the present invention, the pad is formed with a plurality of upper and lower ribs and upper and lower valleys, with the upper ribs being offset from the lower ribs in a manner that the upper ribs are vertically aligned with the lower valleys and the lower ribs are vertically aligned with the upper valleys.

Each rib is made up of a pair of adjacent wall segments, with the wall segments having a minimum material thickness dimension measured between that wall segment's upper and lower surface portions. The wall segments each have alignment planes centered between the surfaces of that segment, and adjacent alignment planes form a pad angle. A preferred range for the pad angle is in this embodiment is between about 60 to 130 degrees, with 65 to 105 degrees being more preferred, and with a pad angle of 70 to 90 degrees being most preferred.

The pad of the preferred embodiment has a total thickness dimension and also a peak-to-peak distance. The ratio of the material thickness dimension to the total thickness dimension is between about 0.2 and 0.7, more preferably between about 0.5 and 0.6, and most preferably between 0.35 and 0.5.

The pad of the preferred embodiment also has a ratio of the peak-to-peak dimension to the rib depth dimension which is between about 0.9 and 4.3, with a more preferred range being between about 1.3 and 2.7, and the most preferred range being between about 1.4 and 2.5.

Further, the pad of the preferred embodiment has a normalized area ratio which is between about 0.3 and 0.8, With a more preferred range being between about 0.5 and 0.75, with the most preferred range being between about 0.6 and 0.7.

The pad has a material elongation ratio which is between about 1.05 and 2.02, with the preferred range being between about 1.1 and 1.6, and With a preferred value being about 1.3.

Desirably, there are a plurality of support members connecting to and extending between at least the upper set of support ribs. These support members are oriented with substantial alignment components perpendicular to a lengthwise axes of the ribs. Desirably, these support members connect to and extend between the lower ribs also. In the preferred form, these support members have an outer surface positioned below the peak areas of the ribs, in a manner that when pad sections are positioned against one another, the ribs of one pad section can become nested with ribs of a second pad section, thereby reducing a volume occupied by the pad sections. Also, the support members are arranged linearly in the preferred form, with axes of alignment of these support members slanted relative to a second axis, so that when the pad is rolled in a stowed position, support members of different pad sections which are positioned adjacent to one another are offset from one another along a first axis. The preferred spacing of these support members is that they are no further apart than about six inches, and desirably less than four inches, and more desirably less than 2.75 inches.

Desirably, the support members are slanted to the second axis at an angle less than about half a right angle, and more desirably at an angle between about seven and twenty degrees, and most desirably about eight degrees.

In the preferred form, the ribs form with the support members enclosed pocket recesses which define insulating pocket areas. Desirably, these pocket recesses are formed at both the upper and lower surface.

In another embodiment, the pad is formed with elongate ribs on only one side of the pad, while in a further embodiment, such ribs are provided on both surfaces of the pad.

In another embodiment, protrusions having a circumferential side wall are provided on one surface of the pad, and in another embodiment such protrusions are provided on both sides of the pad. At least a portion of the side wall tapers upwardly so that the peak area of the protrusion is less than the base area of the protrusion. In one of these embodiments, the protrusions on opposite surfaces of the pad are vertically aligned with one another, and in another embodiment such protrusions are laterally offset from one another. In the latter configuration, in one arrangement the surfaces are provided with recesses, with the lower recesses being aligned with the upper protrusions, and the upper recesses being aligned with the lower protrusions.

There are preferred configuration and dimensional relationships associated with each of the embodiments noted above, and these are described in more detail in the following detailed description.

In the method of the present invention, there is provided a closed cell foam polymer workpiece having a known thermoforming temperature and a thickness dimension. At least one mold member having a forming surface with a plurality of protruding portions is applied to the workpiece which is at a temperature at least as high as the thermoforming temperature. This forms the workpiece with the desired pattern of raised portions and recessed portions Further, the workpiece is formed in a manner that cells in the workpiece are elongated in a direction of elongation of the workpiece.

In one preferred form of the process, the mold is at a temperature below the thermoforming temperature, thus simultaneously cooling and elongating the cells near the surface of the workpiece which is being formed. In the preferred form, two such molds are provided.

In accordance with another feature of the process of the present invention, there is provided an edge cutting member and an edge compression member positioned adjacent to and inwardly of the cutting member. These engage an edge portion of the workpiece to trim the edge portion of the workpiece and form a trimmed edge with a relatively narrow compressed edge portion which has a relatively high density and a relatively high tear resistance.

In the preferred form, the workpiece is engaged in a manner to provide for the appropriate deformation of the workpiece to form the pad configurations as described above, and also to provide the proper orientation and elongation of the cells to give desired structural characteristics to the pad which is formed. The structure of the mold or molds used in the process of the present invention are significant, and design parameters of these are given in the following text.

Other features of the present invention will become apparent from the following detailed description.

Figure 3:
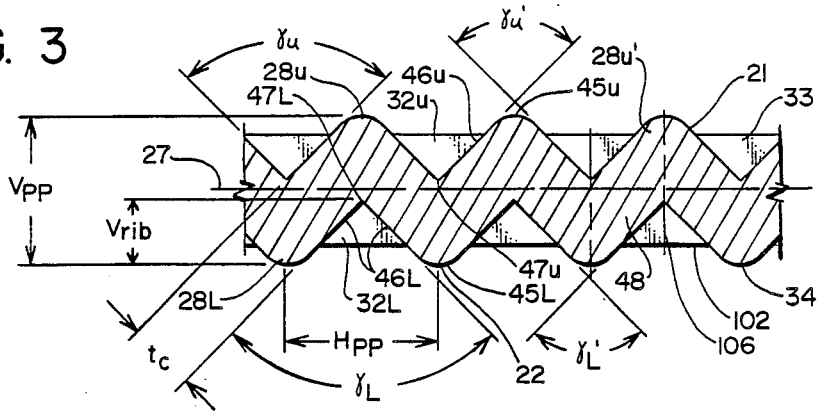
FIG. 3 is a partial side sectional view of the support pad of the present invention.
Figure 16:
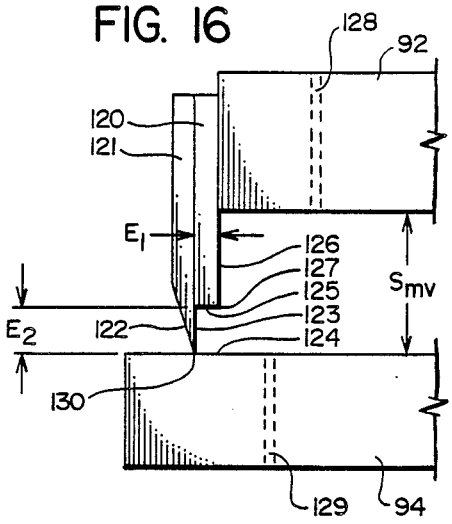
FIG. 16 is a sectional view of an edge portion of a mold which is utilized in the present invention and which incorporates edge forming and trimming features.
Figure 19:
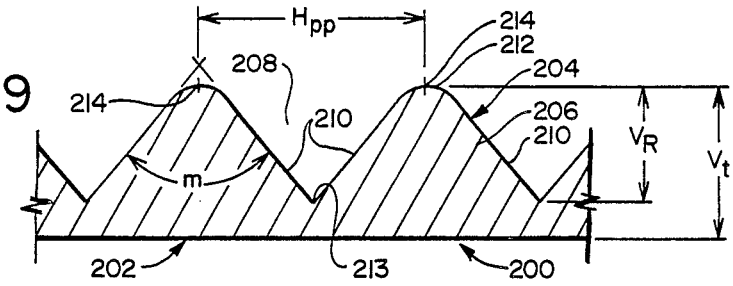
Figure 20:
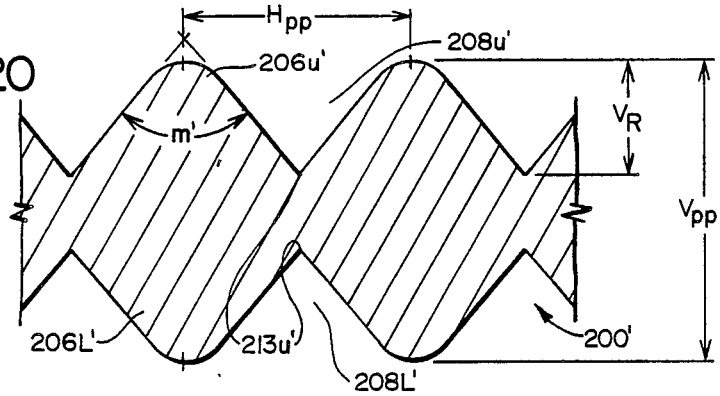
Figure 21:
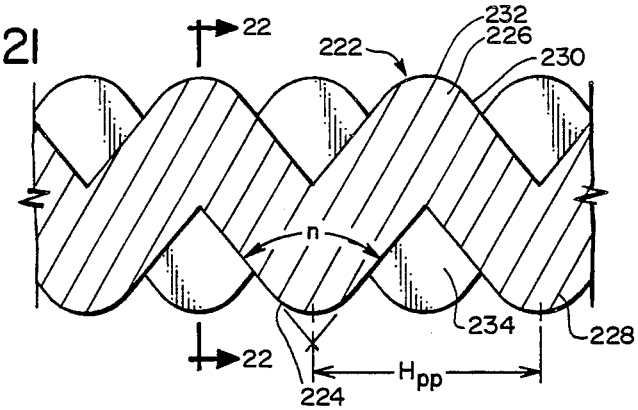
Figure 22:
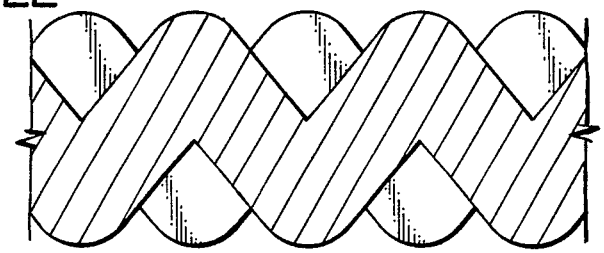
Figure 23:
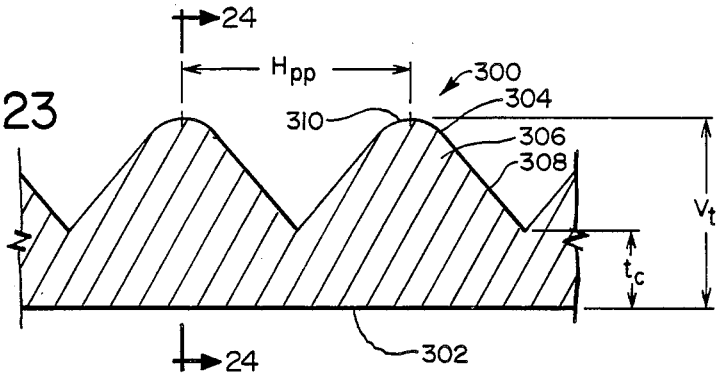
Figure 24:
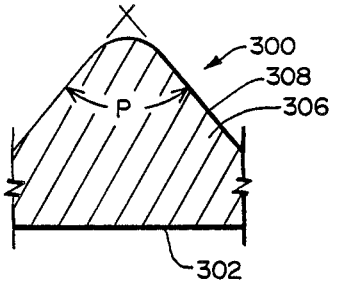
Figure 25:
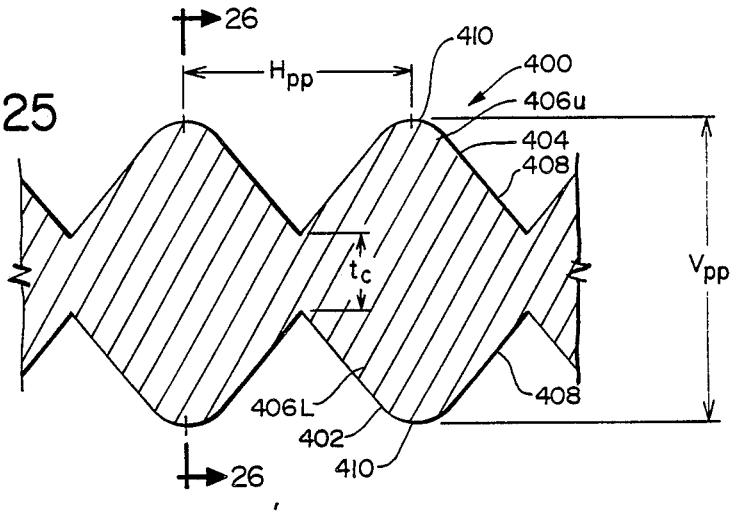
Figure 26:
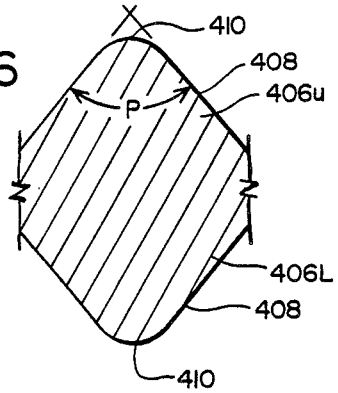

FIGS. **18*a*, 18*b*, and 18*c* illustrate the compression, densification, molding and trimming of a foam pad using the mold detailed in FIG. 16**;

FIG. 19 is a sectional view, similar to FIG. 3, showing a second embodiment of the present invention;

FIG. 20 is a view similar to FIGS. 3 and 19, showing a third embodiment of the present invention;

FIG. 21 is a sectional view similar to FIGS. 3, 19 and 20 of yet a fourth embodiment of the present invention;

FIG. 22 is a sectional view taken along line 22—22 of FIG. 21;

FIG. 23 is a sectional view similar to FIGS. 3, 19, 20, and 21, showing a fifth embodiment of the present invention;

FIG. 24 is a sectional view taken along lines 24—24 of FIG. 23;

FIG. 25 is a sectional view similar to FIGS. 3, 19, 20, 21 and 22, showing a sixth embodiment of the present invention; and FIG. 26 is a sectional view taken along line 26—26 of FIG. 25.

Figure 13:
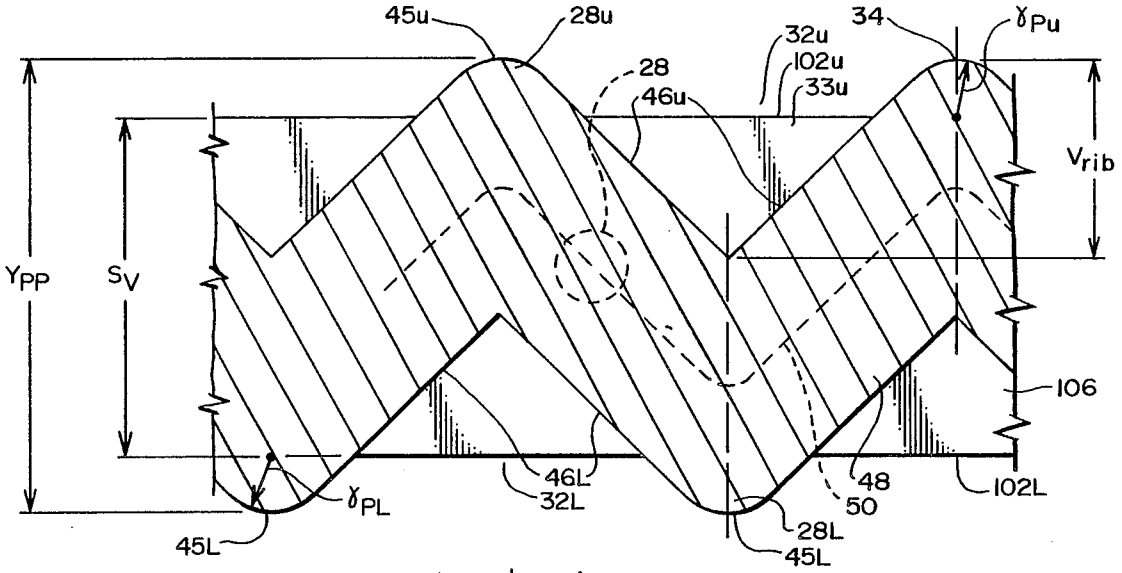
FIG. 13 is a partial side sectional view of the support pad of the present invention.
Figure 27:
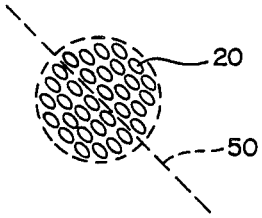

FIG. 27 is a sectional view of the oblong cells taken from the portion shown in FIG. 13.

While the present invention is susceptible to various modifications and alternative forms, specific embodiments thereof have been shown by way of the Drawings and will herein be described in detail. It should be understood, however, that it is not intended to limit the invention to the particular forms disclosed, but on the contrary, the intention is to cover all modifications, equivalents and alternatives falling within the spirit and scope of the invention.

DETAILED DESCRIPTION

The present invention pertains to a closed cell foam support pad having increased comfort and compliance, resistance to tear, and insulation properties, as well as a process and mold for making the closed cell foam support pad.

As indicated in the Background, closed cell foams are desirable for their good insulating properties, low mass, resistance to moisture absorption, and their relative compactness. However, the properties of closed cell foams which provide these desirable characteristics, that is the individual closed cells, tends to make a closed cell foam structure less comfortable. The comfort of a support pad is a direct function of its ability to gradually deform when subjected to a compressing force. Compliance, or the amount of compression of a material resulting from a given load, is a measurable quantity and is useful when comparing the comfort of various pads.

Several open cell and closed cell support pads which have been disclosed in the Background utilize various structural patterns to control their compliance. It has been found in the present invention, however, that compliance of a closed cell foam is a function of (1) the ratio of the uncompressed vertical cross-sectional area of the pad to the uncompressed height of the pad, (2) expansion of compressed foam at exposed, unrestrained surfaces, (3) bending of formed pad members and (4) tension in formed pad support members. This will be explained more fully below.

Figure 1:
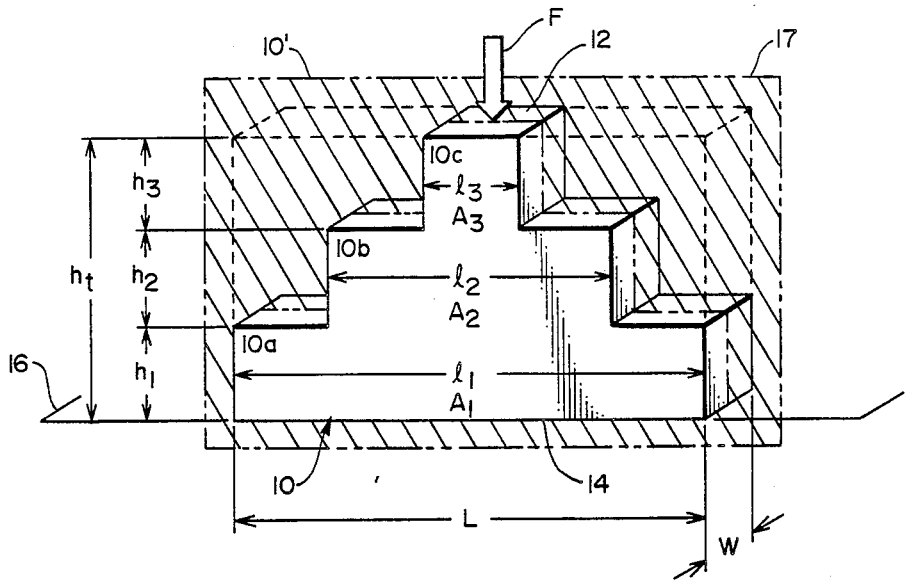
FIG. 1 is a model of a closed cell foam structure used in an analysis of the relationship between compliance and the uncompressed vertical cross-sectional area of a closed cell foam structure and the uncompressed height of the structure.

There is shown in FIG. 1 a model of a closed cell foam structure indicated at 10 having a top surface 12, and a bottom surface 14 which is supported on an underlying surface 16. This foam structure can be modeled as three volumes 10*a*, 10*b* and 10*c*, each of which has a length l and a height h; the widths w of each volume being treated as constant for all compressive forces and therefore ignored in the following discussion. The uncompressed total height $h_{ut}$, of foam structure 10 is defined by the vertical distance between upper surface 12 and lower surface 14, when the structure 10 is not subjected to loading. An uncompressed vertical cross-sectional area $A_u$, i.e. that area which lies in an imaginary vertical plane 17, is defined as the sum of the vertical cross-sectional areas $A_1=l_1h_1$, $A_2=l_2h_2$, and $A_3=l_3h_3$. In accordance with the present invention, an increased compliance is provided by forming a structure in which the ratio of the uncompressed area $A_u$, to the total uncompressed height, $h_{ut}$, is minimized, as shown by the following analysis.

During compression of the closed cell foam structure 10 by a downward acting force F per unit width w, the rigidity of the cell walls, which is very small, is assumed to be zero for purposes of analysis The compliance, C, (or softness) of the structure 10 is $$C = 1 - \frac{h_{ct}}{h_{ut}}; \qquad \text{(Eq. 1)}$$

where $h_{ct}$ is the total height of the structure after being compressed. It is assumed that the ideal gas law for isothermal compression is valid, i.e. $P_uV_u=P_cV_c$, where $P_u$=the uncompressed pressure of the gas within the cells $V_u$=the uncompressed volume of any structure 10 and is equal to $l_ih_u$ per width unit (ignoring the constant w), $h_u$, which is the same for each block in the model, is the uncompressed height of the individual block, $P_C$=the compressed pressure of the gases included in any structure 10, and $V_C$=the compressed volume of any structure 10, and is equal to $l_ih_{ci}$.

In general, $$P_c=F/l \qquad \text{(Eq. 2);}$$

therefore by substitution into the Ideal Gas Law, in the compression of only one structure, $$P_ul_ih_u=(F/l_i)l_ih_{ci} \qquad \text{(Eq. 3);}$$

and by algebra $$h_{c1}=(P_u/F)h_ul_1$$

$$h_{c2}=(P_u/F)h_ul_2$$

$$h_{c3}=(P_u/F)h_ul_3$$

By summing $h_{c1}$, $h_{c2}$, $h_{c3}$, the total compressed height is:

$$h_{ct} = \sum_{i=1}^{3} h_{ci}$$

or $$h_{ct} = (P_uh_u/F) \sum_{i=1}^{3} l_i \qquad \text{(Eq. 4)}$$

In the limit as the height of the uncompressed element approaches zero and the number of elements i approaches infinity $$\lim_{\substack{h_u \to o \\ n \to oo}} h_u \sum_{i=1}^{n} l_i = A_u \qquad \text{(Eq. 5)}$$

where $A_u$ is the uncompressed cross-sectional area.

By substitution of Eq. 5 into Eq. 4:

$$h_{ct}=P_uA_u/F \qquad \text{(Eq. 6).}$$

By further substitution into Equation 1

$$C=1-(P_uA_u/Fh_{ut}) \qquad \text{(Eq. 7).}$$

Thus as the ratio $A_u/h_{ut}$ increases, i.e. an increasing $A_u$ or a decreasing $h_{ut}$, compliance decreases.

Assume structure 10' in FIG. 1 is defined by a unit length L, an uncompressed height $h_{ut}$ and by the constant w. When $A_u$ is less than $h_{ut}L$; the compliance increases in accordance with equation 7. In other words, C increases when $A_u$ is less than $h_{ut}L$; or stated another way, compliance increases when $A_u/(h_{ut}L)$ is less than 1.

For ease of discussion, the ratio $A_u/(h_{ut}L)$ will be henceforth termed the normalized vertical cross-sectional area $A_n$ or the normalized cross-sectional ratio.

This analysis shows that the normalized vertical cross-sectional area strongly influences the compliance of a pad made from closed cell foam. This discovery allows one to select the pad geometry with the best compliance from a set of candidate geometries.

The preceeding analysis ignores the ability of exposed, unrestrained surfaces of a structure to expand, or bulge outward when subjected to compressive forces. If significant exposed, unrestrained surfaces are near or under highly loaded areas, net pad compliance greater than that indicated by the above analysis (Equation 7) is possible. Thus, one can significantly control the compliance of a pad by controlling the unrestrained surface area and its shape.

Figure 14:
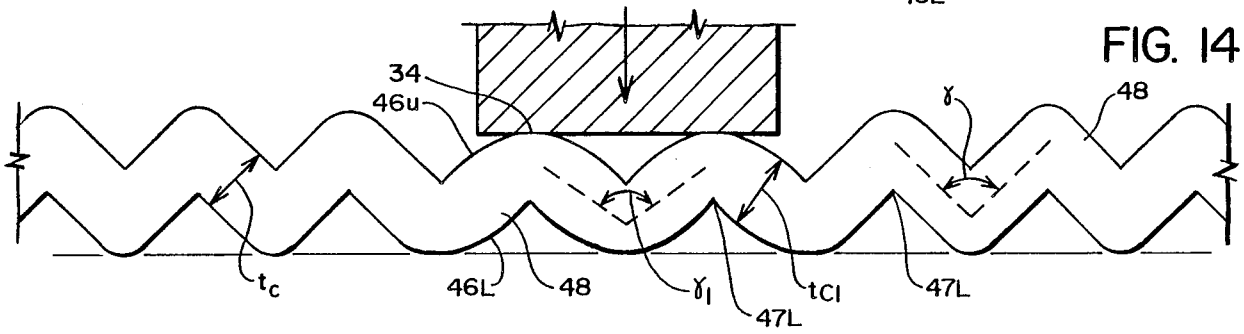
FIG. 14 is a partial side sectional view of a support pad of the present invention undergoing compression.

It should also be noted that for the present invention (FIGS. 2 and 3), the sharpness of the angle of the corrugations has an effect upon the resistance of the ground pad to compression loading Referring to FIG. 14, let it be assumed that the corrugations have a relatively narrow angle ($\gamma$ is small), and that a load is applied over several ribs As the foam at the peak of the rib is compressed downward, there is resistance to this downward movement which is offered by the foam positioned on either side of the peak: $\gamma$ increases to $\gamma_1$ as the rib members bend and $t_c$ increases to $t_{c1}$ as the unrestrained rib surfaces bulge out. If $\gamma$ is small, then the ribs would take most of the load in compression and very little in bending. If l is increased such that little of the load is taken in compression and more is taken in bending (of the rib members) then compliance will be increased. This is because closed cell elastomeric foam, which is mostly air, is much stronger in compression than in bending.

In review, there are several mechanisms by which compliance may be increased: (1) Selective compression of volumes as shown by Equation 7, (2) tailoring exposed, unrestrained surface area and shape to allow displacement through expansion or bulging, and (3) adjusting the angles at which members act on each other so as to result in bending rather than compression of the polymer structure.

The ingenious use of these discoveries, in conjunction with the use of tensile support members (to be explained more fully later) can allow the systematic engineering of pad compliance given an understanding of the material being used.

Figure 2:
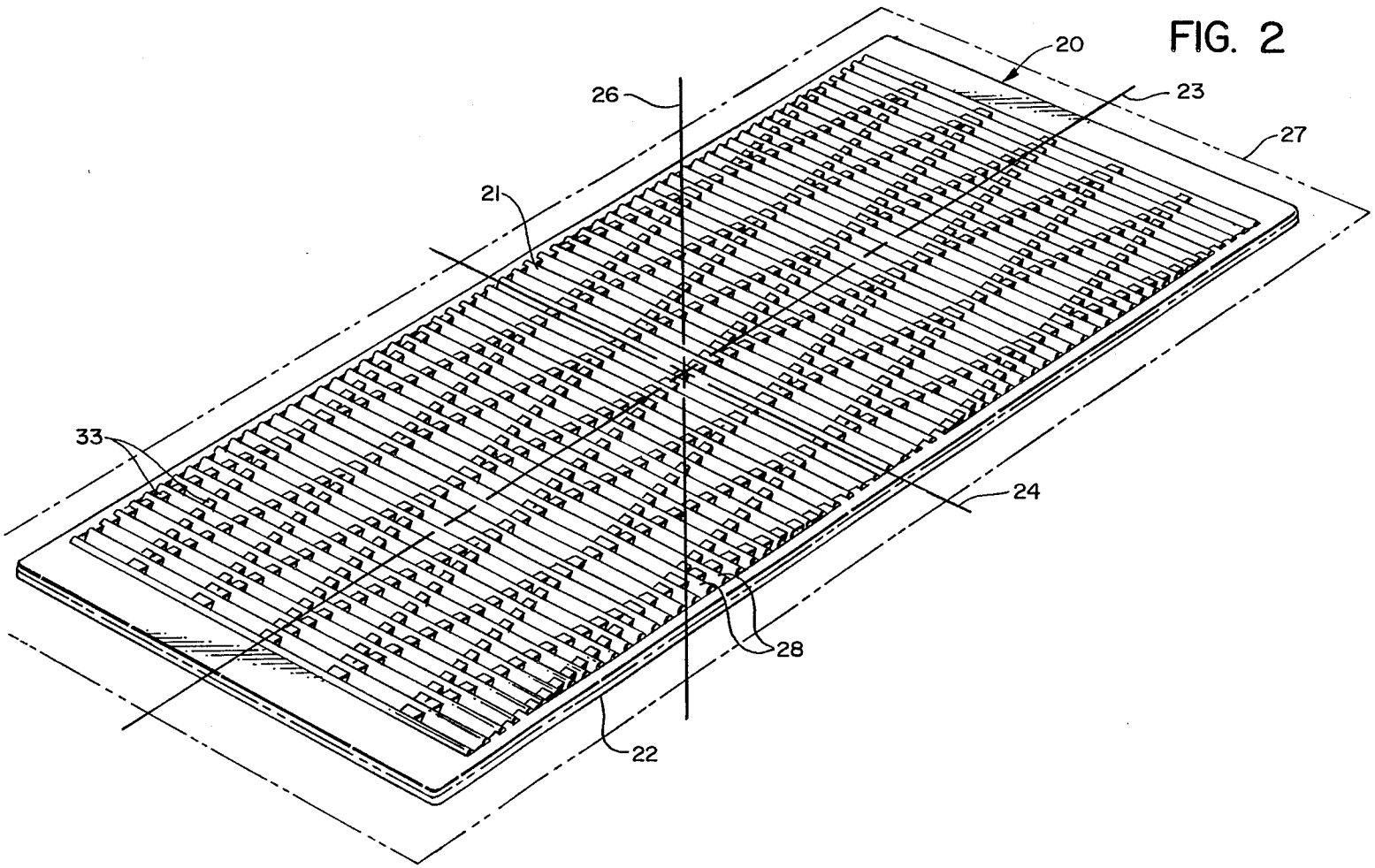
FIG. 2 is an isometric view of the support pad of the present invention.

It has been found that a preferred compliance in a closed cell foam pad is achieved by the corrugated pattern shown in FIGS. 2 and 3, and which is formed by the application of the aforementioned normalized vertical cross-sectional area. Briefly support pad 20 includes an upper surface 21, a lower surface 22, a lengthwise axis 23, a transverse axis 24 and a vertical axis 26, as well as an imaginary neutral plane designated by the number 27. Neutral plane 27 is located parallel both to the lengthwise axis 23 and transverse axis 24, and lies midway between the upper surface 21 and the lower surface 22 so as to coincide with axes 23 and 24. The support pad 20 has a corrugated configuration and includes a number of ribs 28 at its upper and lower surfaces and which are separated by valleys 32 and which extend parallel to the transverse axis. The pad is supported by a number of lengthwise extending stringers 33; the structure and function of stringers 33 to be described in further detail later.

More specifically, the support pad 20 includes upper and lower extending ribs 28U, 28L (FIGS. 3 and 13), respectively, and upper and lower extending valleys 32U, 32L, respectively, the ribs 28U being vertically aligned above the valleys 32L and the valleys 32U being vertically aligned above the ribs 28L. While the valleys 32 have a V-shaped cross-section, each rib 28 has a rounded end surface 34 at the outer apex portion for reasons to be explained later. The points of maximum vertical distance between neutral plane 27 and each rib 28 define a transversely extending ridge line 45. The maximum height of the rib 28 relative to an adjacent valley 32 is shown as $V_{rib}$ (See FIG. 13 ). Each pair of adjacent upper ribs 28U, 28U' are separated by an upper valley 32U which is defined by surfaces 46U which intersect at a transversely extending valley line 47U to form an angle $\gamma_U$. A portion of each rib 28U is also defined by the surfaces 46 which terminate at the rounded end surface 34 of each rib and form an angle $\gamma_U'$; $\gamma_U$ being equal to $\gamma_U'$. Likewise, each pair of adjacent lower ribs 28L, 28L' are separated by a valley 32L which is formed by planar surfaces 46L which intersect at a transversely extending valley line 47L to form an angle $\gamma_L$; $\gamma_L$ being equal to $\gamma_U$. A portion of the rib 28L is also defined by the surfaces 46L which terminate at the rounded end surface 34 of the rib 28L and form an angle $\gamma_L'$; $\gamma_L'$ being equal to $\gamma_U'$.

In the present invention, pad angles $\gamma$, $\gamma'$ between about sixty degrees and one hundred and thirty degrees are preferred; pad angles between about sixty five and one hundred and five degrees being more preferred; and a pad angle of between about seventy and ninety degrees being most preferred. A preferred radius $r_v$ (FIG. 13) at the apex or valley line of the valley 32L or 32U is less than 0.3 inches, and more preferably less than 0.02 inches. Furthermore, the material thickness dimension $t_c$ of the support pad is relatively constant, the thickness dimension $t_c$ being defined as the shortest distance between each pair of adjacent slanted surfaces 46U and 46L which define a single wall segment 48, with each wall segment 48 being a section of the pad extending between a vertical plane passing through an upper rib peak line 45U and a vertical plane passing through an adjacent lower rib peak line 45L. In the present invention, $t_c$ of between 0.15 and 0.75 inches is preferred, with $t_c$ of between 0.21 and 0.54 inches more preferred and $t_c$ of about three tenths of an inch or between 0.25 and 0.33 inches most preferred.

In a preferred configuration of the present invention, the ribs and valleys are parallel to each other and are parallel to the transverse axis of the pad. Within the broader aspects of the present invention, the ribs and valleys could (1) deviate from a straight line, (2) need not be parallel to the transverse axis of the pad, (3) need not be parallel to each other, and (4) need not be on both sides of the pad yet still achieve many of the benefits of te preferred configuration.

Also defined in FIG. 3 is a horizontal peak-to-peak distance, $H_{pp}$, between adjacent upper rib peak lines 45U, or adjacent lower rib peak lines 45L; and, a maximum vertical peak-to-peak distance $V_{pp}$ which is the "total thickness dimension", that being vertical distance between a plane coincident with the upper ridge lines 45U and a plane coincident with the lower ridge lines 45L. In the present invention a vertical peak-to-peak distance, between about 0.3 inches and 1.5 inches is preferred, with a $V_{pp}$ between about 0.5 and 1.0 inches more preferred, and a $V_{pp}$ of about 0.7 inches being most preferred. A pre horizontal peak-to-peak distance $H_{pp}$ of less than about three inches is preferred, with $H_{pp}$ less than one and one quarter inches more preferred and an $H_{pp}$ of 0.75 inches or about three quarters of an inch is most preferred.

For a preferred configuration of the present invention having ribs on two opposing surfaces, the preferred rib depth $V_{rib}$ is such that: 0.17 inches$\leqq V_{rib} \leqq$0.84 inches, whereas 0.2 inches$\leqq V_{rib} \leqq$0.56 inches is more preferred and 0.31 inches$\leqq V_{rib} \leqq$0.5 is most preferred.

Also in accordance with a preferred embodiment of the present invention, support pad 20 is made of a polymer material, most preferably an ethylene-vinyl acetate/polyethylene copolymer, (EVA) of a density preferably between 1 and 25 pounds per cubic foot (pcf), more preferably between 1 and 12 pcf and most preferably between 1 and 4 pcf. It is formed by a molding process, most preferably by thermoforming. Briefly, the thermoforming process of the present invention involves heating a thermoplastic polymer slab workpiece having substantially uninterrupted upper and lower surfaces to a temperature above that determined to be the temperature at which the material begins to become plastic (formable) but is not fluid. This is known as the material's thermoforming temperature, $T_f$. The heated workpiece is then placed in a press having upper and lower molds. The press is then closed to engage the polymer workpiece between the upper and lower molds and with sufficient force to cause the heated pad to flow and conform to the mold patterns. The pad is then cooled and the thermoformed pad is removed.

Although in the present invention EVA foam is preferred, other thermoplastic foams, such as polyethylene foams, cross-linked polyethylene foams, vinyl foams, and the like may be used. Further, foams with uniform cell size and uniform cell distribution and uniform density are preferred. In the broader range, foams with variations in cell size, density distribution, cell distribution, and foam/film and foam/fabric laminates may be used. Further, although the bulk of the discussion herein has addressed a mold having two portions: an upper and a lower portion, within the broader aspects of this patent, the mold may also (1) have portions which dependently or independently move in any single axis or combination of axes, (2) have only one side and use a diaphragm and pressure and/or vacuum to form the pad against the mold, and (3) include a combination of compression molding and vacuum thermoforming to form the pad against the tool.

Further, the workpiece from which the pad is made is in the preferred form in the shape of a rectangular prism having length and width dimensions generally corresponding to the length and width dimensions of the pad being formed, and having a thickness dimension which is approximately the same as the total thickness dimension $V_{pp}$ (see FIG. 3) of the pad which is formed. However, the thickness of the slab workpiece may in some instances be less than the final vertical thickness dimension ($V_{pp}$) of the pad. The slab workpiece from which the most conveniently provided has a cellular configuration where the cells are generally spherical or, at most, slightly oblate. When this slab workpiece is formed into the pad of the present invention, the cells of the polymer material become elongated along a material elongation axis to impart certain improved properties to the pad of the present invention. (This will be described more fully later herein.)

Figure 4:
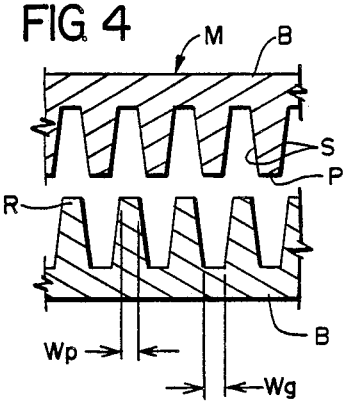
FIG. 4 is a cross-sectional view of a mold which is not used in the present invention and which is shown to illustrate certain mold parameters.

Referring to FIG. 4, there is shown a portion of a hypothetical mold which is not used in the present invention, but which is provided to show a nonoptimal mold pattern as well as to define several variables associated with the mold pattern. In FIG. 4, the mold M includes upper and lower portions each having a base B and a number of extending ridges R. Each ridge R is formed by opposing sidewalls S which extend from the respective bases and terminate at end surfaces P; the lengthwise dimension of the end surface P defining a mold plateau width $W_P$. Each ridge R is separated from the adjacent ridge R at the base of the sidewalls S by a horizontal distance which is defined as a mold groove width $W_g$. In accordance with the normalized vertical cross-sectional area analysis, it would be logical to assume that increased compliance would result from an increase in mold plateau width $W_p$. This is because an increase in mold plateau width causes an increase in the valley width of the formed pad, and which in turn reduces the normalized vertical cross-sectional area $A_n$. It has been found in the present invention, however, that it is desirable in the thermoforming of pad 20 that the value of mold plateau width $W_P$ be as small as possible; that is the value of $W_p$ approaches zero. It is recognized a plateau width of zero is unachievable, however, a plateau width which is as small as may be achieved practically is desirable.

It has been found that when a mold plateau width $W_p$ of 0.3 inches or greater is used, the resulting pad is degraded substantially, both in performance and appearance as will be discussed in further detail later. By utilizing larger plateau widths, too much material is permanently deformed by the ridge plateaus resulting in the degradation of the formed pad.

Figure 5:
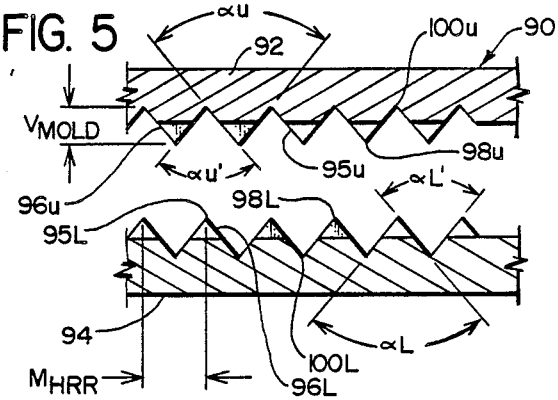
FIG. 5 is a cross-sectional view of the mold utilized in forming the support pad of the present invention and taken along line 5—5 of FIG. 11.
Figure 11:
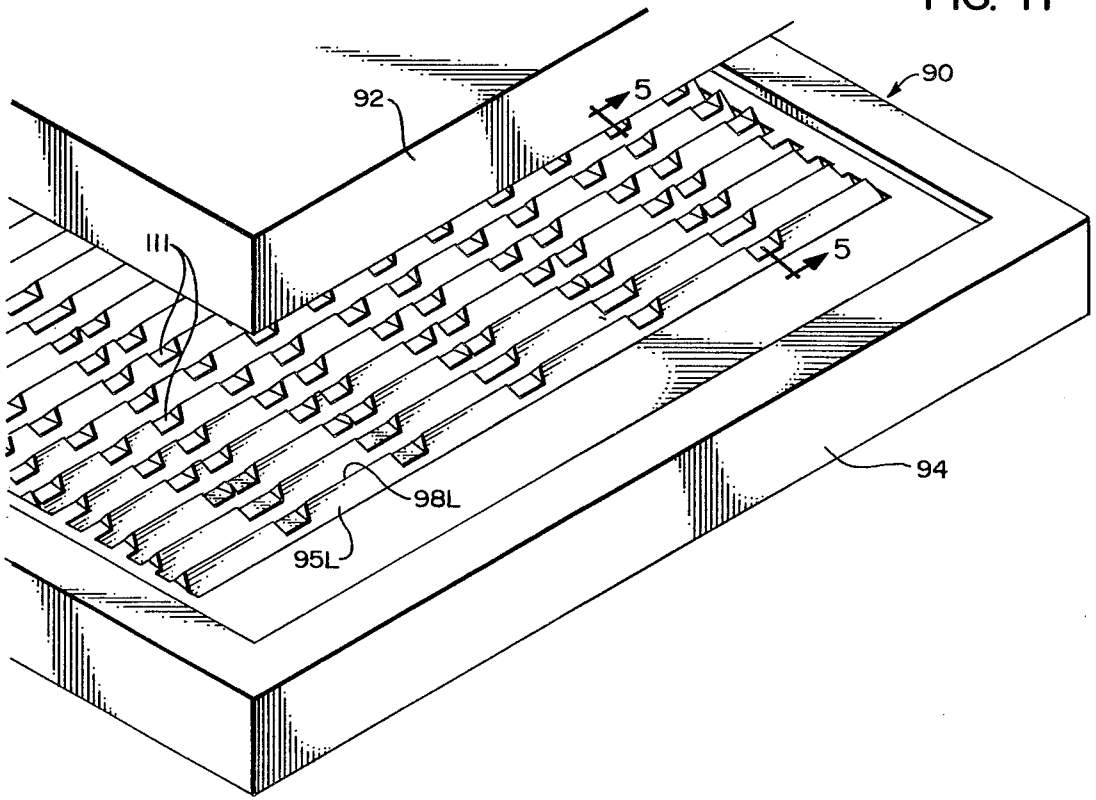
FIG. 11 is a partial isometric view of the mold utilized in the process of the present invention.

In carrying out the process of the present invention, there is shown an exemplary mold generally indicated at 90 in FIGS. 5 and 11, which includes an upper mold portion 92 and a lower mold portion 94. The upper mold portion 92 includes a number of downwardly depending transversely extending ridges 95U, each of which is formed by opposing angled linear sidewalls 96U which join at a transversely extending ridge line 98U to form an angle $\alpha_u$. The base of each sidewall 96U joins with the sidewall 96U of the adjacent ridge at a transversely extending groove line 100U to form an angle $\alpha_u'$. A vertical distance between ridge line 98U and groove line 100U is defined by the variable $V_{mold}$.

When the unformed pad has a more preferred thickness $t_u$ of between about 7/16 and about $\frac{5}{8}$ inches $V_{mold}$ is preferably between about 0.46 and 0.62 inches; more preferably between about 0.52 and 0.56 inches; and most preferably about 0.54 inches. A horizontal ridge-to-ridge distance on the mold $M_{HRR}$ between about 0.30 inches and about 0.84 inches is preferred, and an $M_{HRR}$ of 0.73 inches is more preferred. Preferably the plateau ridges 95 have respective plateau widths which are less than 0.3 inches, and more preferable plateau widths $W_P$ which are less than 0.02 inches. In order to maximize compliance by decreasing normalized vertical cross-section area $A_n$, the mold groove width $W_g$ is also as small as practicable with a preferred mold groove width $W_g$ which is less than 0.03 inch, and a more preferred mold groove width less than 0.02 inches. The lower mold portion 94 is nearly identical to the upper mold portion 92, however, the ridges 95L of the lower portion are displaced along the lengthwise axis from the ridges 95U so that the ridge lines 98U, 98L vertically align with the groove lines 100L, 100U, respectively, during molding of the workpiece. At maximum closure of the mold, a minimum vertical distance between the upper ridge line 98U and lower ridge line 98L is defined by a variable $D_{CLOS}$ (FIG. 5). When the unformed pad has a more preferred thickness $t_u$ of between about 7/16 and $\frac{5}{8}$ inches, $D_{CLOS}$ is between about −0.24 inch (a negative quantity indicating ridge overlap) and about 0.2 inches a more preferred $D_{CLOS}$ range between about −0.18 inches and about 0.08 inches; a most preferred range between about 0.11 and 0.05 inches; and an optimum $D_{CLOS}$ of −0.05 inches.

It is found that by utilizing the mold of the present invention, that not only is there an optimization of compliance, but in addition, the pad has increased resistance to tear due to both foam densification and polymer orientation within the pad. During the present thermoforming molding process, the polymer workpiece is compressed from its initial thickness $t_u$ to a compressed thickness $t_c$. The overall compression of the workpiece by the mold causes cells at or near the outer surface of the workpiece to be compressed. The resulting increase in density of the material near the surface forms a tough skin. This skin has a significant resistance to abrasive forces which are typically encountered when the pad is supported on a rough surface, such as in a camping environment. It has been found that a rib radius $r_p$, as shown in FIG. 13, achieves a good balance between compliance and durability when $r_p$ is preferably such that about 3/32 inches $\leqq r_p \leqq$ 7/32 inches and more preferably 3/32 inches $\leqq r_p \leqq$ 5/32 inches.

In the present invention, utilizing a workpiece having a preferred initial thickness $t_u$ between about 3/10 and about 9/10 inches, and a more preferred initial thickness $t_u$ of between about 7/16 and about ⅝ inches, it is preferable to compress the workpiece so that the material thickness dimension $t_c$ is less than 9/10 of the thickness, $t_u$, of the initial workpiece and more preferably so that $t_c$ is from about five tenths to about seven tenths of the initial thickness $t_u$ of the workpiece. Although increased compression results in greater skin density, there is a corresponding reduction in support and thermal insulation, therefore, when using a workpiece of initial thickness between 7/16 and ⅝ inches, a compressed thickness (i.e. the material thickness dimension $t_c$) of between about 5/10 $t_u$ and about 7/10 $t_u$ is most preferred to provide sufficient thermal insulation and comfort at maximum loading.

In the formation of the ground pad, it is stated above that a compressive force is applied to the foam to give it its corrugated pattern. However, it should also be recognized that as this occurs there is a stretching of the foam to allow it to follow the contour of the mold. In other words, since the centerline length of the foam (as measured midway between rib surfaces 46U and 46L) is increased by following the convoluted or corrugated pattern in a direction perpendicular to the lengthwise direction of the ridges and valleys, there is a stretching along a line that follows the corrugated pattern. Thus, the individual cells are compressed in one direction because of the loading, but are stretched in another direction to follow the contour. This stretching causes lengthwise orientation of the foam microstructure which further enhances the pad's resistance to tearing and tensile stresses Further, in a preferrred configuration where both sides of the pad have ribs and where the ribs on one surface are substantially parallel though not vertically aligned with the ribs on the other side, it has been found (1) that the polymer orientation is continuous along the entire elongated centerline dimension of the foam and (2) that orientation extends throughout the thickness of the formed pad. This results in an increased ability of the formed pad members to resist unwanted buckling when under loads which induce compression and/or bending in the foam structure. This full-depth orientation is a significant finding and improvement over that available in thermoformed pads having planes of symmetry which are parallel to their neutral axes.

Further, it has been found that it is desirable to form the initial workpiece by use of molds which are at a lower temperature than the workpiece being formed (i.e. at a temperature lower than the thermoforming temperature of the material). Thus, for a thermoforming temperature of above 160 degrees Farenheit, the molds would desirably be at room temperature, or in any event less than about 120 degrees Farenheit. Further, the molds are desirably made of a material having good heat conductive characteristics (i.e. steel or aluminum) so that heat from the workpiece is dissipated into the mold during the thermoforming process. Further, the mass of the molds should be sufficiently great, relative to the total mass of the workpiece being formed, so that the molds provide a sufficient heat sink for the heat contained in the polymer workpiece. For example, if the polymer workpiece being formed has a total mass of about one pound, the mass of the two molds would be at least as great as about twenty pounds, and more desirably at least as great as forty pounds. Thus, during the thermoforming process, the molds are both forming and cooling the foam material into the final pad shape. As an added benefit, it is believed that the initial rapid cooling of the surface portions of the workpiece contacted by the molds enhances the toughness of the surface material of the pad.

It would be logical to assume that the formed pad would be weakest along the valley lines 47 (FIG. 3). This was typically the case in conventional corrugated or convoluted pads which were formed by saw cutting a standard piece of flat foam. Typically, the reduced thickness and weakening of the saw cut portions along the valleys allowed the pad to tear easily along the valley lines. In the present invention, however, the valley lines of the pad are actually stronger and more resistant to tear than the other portions of the pad. During the thermoforming molding process, the displacement of the polymer material by the mold ridges 95 produces an elongation and an increase in polymer density in a direction which is perpendicular to the valley lines 100. It is believed the aforementioned polymer orientation and densification result in the increased resistance to tear along the valley lines.

Figure 17:
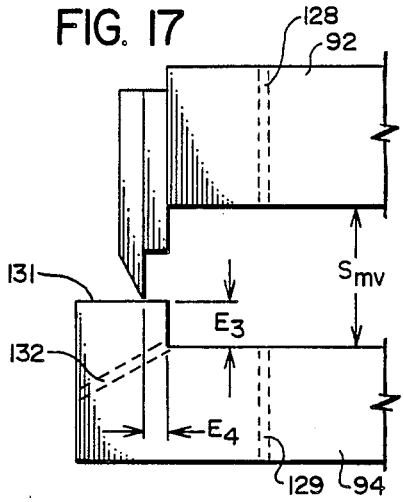
FIG. 17 is a sectional view of a modified edge portion of a mold which is utilized in the present invention and which incorporates a stepped lower mold edge cutting surface.

In addition to increasing the tear resistance of the surfaces of a pad, it is desirable to maximize the resistance to tear initiation along the pad edges. In the present invention foam densification and edge trimming were combined into one step which was done concurrently with pad surface molding FIGS. 16 and 17 illustrate the details of two edge forming/edge trimming approaches which were found to work well.

FIG. 16 shows a preferred mold configuration having an edge forming member 120 having a forming surface 126, a compression surface 125 of width $E_1$, and a transition zone 127 which connect 126 and 125. Also shown is an edge cutting member 121 haVing an interior forming surface 123, and exterior forming surface 122 and a cutting edge 130. The edge forming member 120 and the edge cutting member 121 are mounted to the upper mold portion 92 so that the cutting edge 130 of the edge cutting member 121 contacts the lower mold portion 94 at a lower mold cutting surface 124 when the compression surface 125 of the edge compression member 120 is a distance $E_2$ from the lower mold cutting surface 124. Also shown is the vertical mold spacing, $S_{mv}$, which determines the thickness of the molded pad next to the trimmed edge, and the upper and lower mold vents 128 and 129 respectively.

Figure 18A:
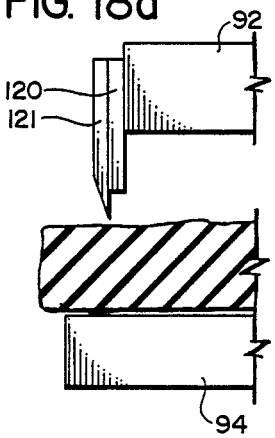
Figure 18B:
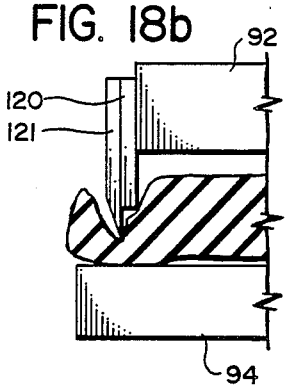
Figure 18C:
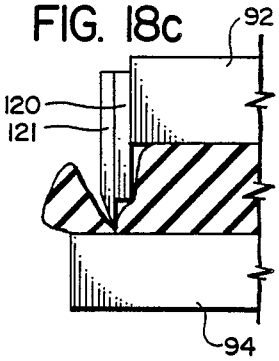

In use a preheated workpiece of thickness $t_u$ is placed on the lower mold portion 94. The upper mold portion 92 with edge compression member 120 and edge cutting member 121 attached are lowered onto the workpiece. The cutting edge is first to contact the workpiece and, if it were not for the edge compression member 120, the edge cutting member 121 would easily shear through the softened foam. However, by proper choice of edge compression member width $E_1$ and edge compression member setback $E_2$, the hot foam can be compressed and densified until the cutting edge 130 meets the lower mold cutting surface 124 accomplishing pad trimming. This process is shown in stepwise fashion in FIGS. 18*a*, 18*b* and 18*c*.

For pads of a preferred configuration having a workpiece thickness $t_u$ such that 7/16 inches$\leqq t_u \leqq \frac{5}{8}$ inches and $S_{mv} \leqq t_u$ it is preferred that $E_1 \leqq \frac{1}{2}$ inch and $E_2 \leqq \frac{3}{4}$ $S_{mv}$, it is more preferred that $E_1 \leqq \frac{1}{8}$ inches and $E_2 \leqq \frac{1}{2}$ $S_{mv}$ and it is most preferred that 1/32 inches$\leqq E_1 \leqq$3/32 inches and 0.010 inches$\leqq E_2 \leqq$3/32 inches. Further, in general it is preferred that $E_2 e_1 \leqq 2$.

Further, it has been found to be advantageous to include upper mold vents 128 and lower mold vents 129 to aid in the expulsion of trapped air during molding. Within the broader interpretation of this invention, it is recognized that enhanced air removal and finer molded pad surface detail will result from (i) increasing the number of mold vents and/or (ii) connecting the vents to a vacuum source.

In molding a pad as shown in FIG. 18, wrinkles were found to be induced in the lower surface of the pad just inside the formed and trimmed edge. These wrinkles were eliminated by changing the location of the lower mold stepped cutting surface 131 to a location between the upper and lower mold surface as shown in FIG. 17. The lower mold stepped cutting surface height $E_3$ is preferably less than 0.95 $S_{mv}$, more preferably 0.2 $S_{mv} \leqq E_3 \leqq 0.8$ $S_{mv}$, most preferably 0.4 $S_{mv} \leqq E_3 \leqq 0.6$ $S_{mv}$ and optimally $E_3 = 0.5(S_{mv} - E_2)$. The internal step width $E_4$ is preferably such that 0.2 $E_1 \leqq E_4 \leqq 4E_1$, and more preferably $E_4 = E_1$.

It has also been observed that when using a stepped lower mold cutting surface as shown in FIG. 17, lower vents 132 may also be placed in the mold step corner to minimize vent detail transfer to the molded surface.

For purposes of analysis, the pad of the present invention can be considered as having a material elongation axis, which is generally perpendicular to lengthwise axes of the ribs being formed. In the present embodiment, with the ribs being transversely aligned, the material elongation axis would be generally aligned with the longitudinal axis 23. However, if the alignment of the ribs is changed, then the orientation of the material elongation axis would also have a corresponding change of alignment. This material elongation axis 50 is illustrated in FIG. 13, and it can be seen that it follows a zigzag or corrugated path which is centered between the upper and lower surface portions 46U and 46L of the pad. The material elongation caused by the mold ridges 95 may be determined as the ratio of the initial length of that portion of the workpiece that is formed with ridges along a direction transverse to the ridges being formed, to the elongation axis of that same portion of the workpiece. This can be set forth as an elongation ratio $E_R$ which equals $L_A/L_B$ where $L_B$ is the length of the workpiece prior to thermoforming, and $L_A$ is the length of the material elongation axis after thermoforming.

In the present invention, an elongation ratio $E_R$ between about 1.05 and 2.2 is preferred; an elongation ratio between about 1.1 and 1.6 being more preferred, and an $E_R$ of about 1.3 being most preferred. It has been found that an elongation ratio greater than about 2.2 results in degradation of the foam whereas it is believed an elongation ratio of less than 1.05 does not provide sufficient comfort or tear strength enhancement. The aforementioned increased valley tear strength cannot be attributed simply to the presence of additional polymer material along the valley lines. It has been found that when the plateau width $W_P$ was increased in a test where only one side of a piece of workpiece was corrugated, the resulting pad was no more resistant to tear along the valley lines than when a smaller mold plateau width was used even though additional material was compressed forming the valleys. The implication of this is that even very narrow pad valleys increase the tear resistance of the pad, thereby allowing relatively smaller rib-to-rib spacing, $H_{pp}$. Further smaller values of $H_{pp}$ result in pads with more uniform feeling surfaces which are in turn more comfortable.

In the present invention, it has also been found that the mold angle $\alpha$ is important in achieving an optimum support pad. Specifically, it has been found that larger mold angles increase the pad horizontal peak-to-peak distance, $H_{pp}$, for a constant vertical peak-to-peak distance $V_{pp}$. At mold angles $\alpha$ above one hundred and twenty degrees which form a pad having valley angles $\gamma$ greater than one hundred and thirty degrees, the larger horizontal peak-to-peak distance results in less comfort. That is, the user's body instead of being supported on top of the pad ribs 28, sinks between the ribs 28 and into the valleys 32, providing an uneven "lumpy" feeling In contrast, at smaller mold angles $\alpha$, there is a degradation in the appearance and strength of the pad due to a rupturing or burst-through of the pad skin cover. This occurs predominantly at the surface of the pad along the ribs. This not only adversely affects the appearance of the pad, but it also reduces abrasion resistance by severing the protective skin cover. Small mold angles $\alpha$ also result in smaller pad angles $\gamma$, which are more susceptible to catastrophic buckling rather than elastic compression and bending. In addition to resulting in a pad with non-uniform compliance characteristics, buckling also results in permanent creases in the pad skin, thereby decreasing its durability. So, utilizing the aforementioned ranges of workpiece thickness $t_u$ and mold closure distance $D_{CLOS}$, a mold angle $\alpha$ such that 45 degrees$\leqq \alpha \leqq$120 degrees is preferred with 56 degrees$\leqq \alpha \leqq$90 degrees being more preferred, and 56 degrees$\leqq \alpha \leqq$80 degrees being most preferred; and a mold angle of about sixty eight degrees achieving optimum compliance and optimum horizontal peak-to-peak distance, as well as avoiding burst-through.

Earlier in this discussion, the pad angle $\gamma$ has been described, with reference to FIG. 3, in connection with the angles formed by the side surface portions 46U and 46L of the line segments 48. With the surface portions 46U and 46L being substantially planar and parallel, those pad angles are easily identifiable and ascertained. However, for purposes of further analysis, reference will be made to a main pad angle, and this is the angle formed by alignment planes of two adjacent wall segments 48. An alignment plane is defined as a plane centered between, and aligned with, the side surface portions 46U and 46L of the wall segment.

In regard to the present invention, a preferred configuration of the pad shown in FIGS. 3 and 13, having a minimum pad thickness $t_c$, pad angle $\gamma$, rib radius $r_p$, full thickness height $V_{pp}$ and horizontal peak-to-peak spacing $H_{pp}$ can be shown to have a normalized vertical cross-sectional are of $A_n$ of:

$$A_n = \frac{2A_1 - 4A_2 + 4A_3}{H_{pp}V_{pp}}$$

Figure 15:
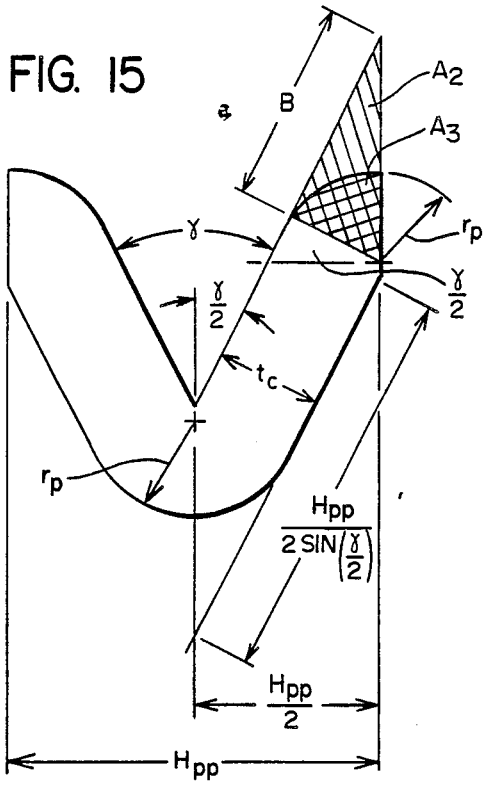
FIG. 15 is a partial side sectional view of a support pad of the present invention illustrating construction elements used in the analysis of pad cross-sectional area.

,where $A_1$, $A_2$, and $A_3$ as shown in FIG. 15 are determined as:

$$A_1 = \frac{t_c H_{pp}}{2\sin\left(\frac{\gamma}{z}\right)}$$

$$A_2 = \frac{r_p B}{2} \text{ where } B = \frac{r_p}{\tan\left(\frac{\gamma}{z}\right)}$$

so:

$$A_2 = \frac{(r_p)^2}{2\tan\left(\frac{\gamma}{z}\right)}$$

$$A_3 = \frac{\pi r_p^2}{4}\left(\frac{90 - \left(\frac{\gamma}{z}\right)}{90}\right)$$

By substitution:

$$A_n = \frac{\left[\frac{t_c H_{pp}}{\sin\left(\frac{\gamma}{z}\right)} - \frac{2r_p^2}{\tan\left(\frac{\gamma}{z}\right)} + \frac{\pi r_p^2\left(90 - \left(\frac{\gamma}{z}\right)\right)}{90}\right]}{H_{pp}V_{pp}}$$

By example, for a preferred case where $\gamma=80$, $r_p=0.125$ inch, $H_{pp}=0.75$ inch, $V_{pp}=0.70$ inch and $t_c=0.30$ inch, the pad's normalized vertical normalized vertical cross-sectional area analysis, the vertical cross-sectional area of the pad is less than the product of the pad uncompressed height, $V_{pp}$, and a unit length L represented by the horizontal peak-to-peak distance $H_{pp}$. In the present invention, $A_n$ is less than 1 and increased compliance over that of a flat pad is obtained. For the present invention, a value of $A_n$ between about 0.3 and 0.8 is preferred, with $A_n$ between about 0.5 and 0.75 being more preferred, and $A_n$ between about 0.6 and 0.7 being most preferred.

In carrying out the present invention, it has also been found that the flexible ribs 28 (FIG. 3) require support along the lengthwise axis of the pad to prevent easy flattening of the ribs 28 when they are subjected to a downward force. In other words, as a result of loading, the ribs bend easily at the peaks and valleys. This tends to increase the lengthwise distance, $H_{pp}$, between the ribs 28 and decrease the vertical peak-to-peak distance $V_{pp}$. To prevent this flattening of the ribs 28, there is provided in the present invention a number of intersecting elongated stringers 33 shown more clearly in FIGS. 2. 6 and 7. The stringers 33 have a truncated triangular configuration when a cross section is taken perpendicular to their lengthwise axis. The stringers include upper stringers 33U (FIG. 6) which are integrally connected to the right and left sidewalls 46U of the upper ribs 28U, as well as lower stringers 33L (FIG. 7) which are connected to the right and left sidewalls 46L of the lower ribs 28L; the lower stringers 33L being vertically aligned with the upper stringers 33U. The stringers 33 are molded into the valleys 32, and each includes a top surface 102, and angled side surfaces 106 (FIG. 7) which converge upwardly at about ten degrees from a lengthwise extending vertical plane. A preferred vertical distance $S_v$ (FIG. 13) between the top surface 102U and the bottom surface 102L being no greater than with $V_{pp}$, with $0.4\ V_{pp}<S_v<V_{pp}$ being more preferred and $0.6\ V_{pp}<S_v<0.8\ V_{pp}$ being most preferred. The width o string as measured between their side surfaces 106 (FIG. 7) is preferably no more than 6 inches, more preferably less than 2 inches and most preferably between 0.1 inch and 0.7 inch. An optimal embodiment would include stringers of width of about $\frac{5}{8}$ of an inch, as measured at the base of the stringer, and about 7/16 of an inch, as measured at the top of the stringer, for $V_{pp}$ of 0.7 inch and 0.27 inch$<t_c<$0.33 inch.

In the present invention, the stringers are spaced apart from one another to not only prevent the separation and flattening out of the ridges, but also to support the user's body to prevent the pockets from collapsing. To accomplish this, preferably the greatest transverse distance $S_D$ (FIG. 7) between the sidewalls 106 of adjacent stringers is not greater than about six inches, more preferably no greater than about 4 inches and most preferably no greater than about two and three-quarters inches. Each stringer 33 has a relatively small height and width dimension, and they are spaced apart at relatively wide transverse locations. By using the stringers 33, optimum compliance is achieved by (i) minimizing the height and width dimensions of each stringer, and (ii) maximizing the transverse spacing between adjacent stringers so as to limit the increase in normalized vertical cross-sectional area $A_n$ caused by the presence of the stringers; while providing sufficient tension along the lengthwise axis to prevent the aforementioned deformation and flattening out of the pad ridges under projected loading conditions. The vertical dimension of the stringers is somewhat less than the vertical dimension of the ribs 28, i.e. stringer top surface 102 is preferably spaced below ridge peak 45, in order to minimize the normalized vertical cross-sectional area $A_n$, while providing sufficient support for the ribs 28U, 28L. The stringers 33 are formed by the aligned notches 111 in the ridges of the mold 92, and/or 94 as shown in FIG. 11.

In the preferred configuration of the present invention, the stringers are located on both sides of the pad which have ribs. Within the broader aspects of the present invention, the stringers could be on only one side of a pad which has ribs and still achieve some of the advantages of the preferred configuration over that of a purely ribbed pad.

Figure 6:
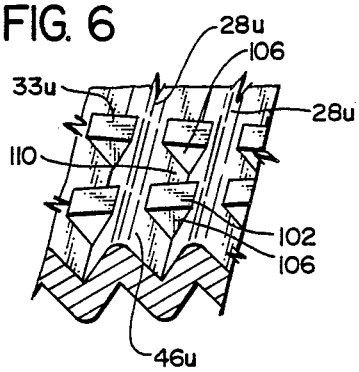
FIG. 6 is a partial isometric view of the support pad of the present invention showing longitudinal stringers for providing lengthwise support to the support pad.
Figure 7:
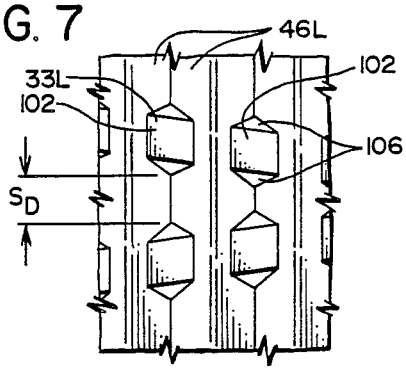
FIG. 7 is a partial top view of the support pad of the present invention.

The combination of the stringers 33 and the ribs 28 form pockets 110 (FIG. 6). The pockets 110 are formed by the sidewalls 106 of adjacent stringers 33, and the valley walls 46. When the pad supports a downward loading, the more compliant ribs deform somewhat, however there is very little deformation of the less compliant stringers so that the pocket 110 retains its basic shape. The stringers 33U forming the pockets 110 on the upper surface of the pad are engaged by the user's body or filled by sleeping apparel, while the stringers 33L forming the lower pockets engage the underlying support surface. The pockets act as (i) barriers to prevent thermal transmission between the user's body and the typically cold underlying surface, and (ii) to prevent thermal convection along the pad valleys.

Additional insulation is also achieved during expansion or bulging of exposed, unrestrained surfaces under and near the loaded area as the foam moves so as to partially fill the valleys resulting in greater effective foam thickness which reduces conductive heat losses. (See FIG. 14)

It has been found that when a pad of a preferred configuration 20 is used on a very soft support surface such as sand, snow or the like, the ribs 28 and stringers 33 can form indentations in the softer support surface when the pad is under load. The interference between the pad surface and the deformed underlying support surface results in an increase in the static coefficient of friction between the formed pad and its supporting surface relative to that achievable between the flat workpiece from which the pad was made and the supporting surface An example of the usefulness of this discovery is that a user of a pad similar to 20 could use the pad on inclined surfaces of a greater angle than those allowable with pads of flat or modestly contoured surfaces.

Figure 8:
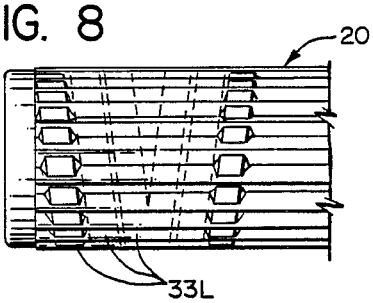
FIG. 8 is a partial end view of the support pad of the present invention after the support pad has been rolled about its transverse axis.

In furtherance of the present invention, the ground pad 20 is adapted to be stored when not in use by rolling it about its transverse axis and securing it by a strap or the like about its outer circumference. Compactness is achieved by at least partial mating of the ridges 28 of one surface within the valleys 32 of the opposing surface (FIG. 2). Compactness is further achieved by the location of the stringers on the support pad so that when the pad is rolled as shown in FIG. 8, the stringers at one surface rarely engage the stringers at the opposing surface. This is accomplished by locating the stringers so that the longitudinal axis of each stringer is at an angle $\beta$ from a line perpendicular to the rib. In the preferred configuration the intersecting stringers 33 form a number of end-to-end diamond patterns (FIG. 2). As the pad overlaps when it is being rolled, the lower stringers 33L engage the upper surface 21 of the pad. However, due to the constantly changing transverse separation of the stringers 33U of each diamond, the lower stringers 33L generally engage the pad upper surface at locations which are transversely adjacent to the upper opposing stringers 33U. In this manner, the stringers 33L, 33U rarely overlap during rolling, thus allowing a more compact roll. Specifically, $\beta$ is preferably no greater than about one half of a right angle (about forty five degrees); a stringer angle of about forty five degrees providing approximately seventy percent of the lengthwise support of a stringer located parallel to the lengthwise axis. At angles less then five degrees, there is insufficient transverse separation between the stringers to fully prevent the lower and upper stringers from overlapping when the pad is rolled about an axis parallel to the rib peak line. More preferably, the stringer angle is between about seven degrees and about twenty degrees, and most preferably the stringer angle is about eight degrees.

Because the valleys 32U are vertically aligned with the ridges 28L, and $S_v$ is less than or equal to $V_{pp}$, a degree of nesting is obtained when several pads 20 are stacked vertically in a flat configuration.

To describe the operation of the present invention in supporting a load, references made to FIG. 14. When a person lies on the pad of the present invention, certain portions of the person's body will exert a downward compressive force on the pad. During the initial loading where the compressive force is rather small, there is first a moderate flattening of the rounded peak areas 34 With further compressive force being applied, there is relatively little compression of the foam material in a vertical direction. Rather, adjacent wall segments 48 begin to deflect angularly in a downward direction to increase the main pad angle $\gamma$ toward 180 degrees. Each wall segment that is subject to the downward compressive force becomes compressed along a direction parallel to the middle alignment plane of that wall segement 48 so that compression occurs in a direction parallel to the lengthwise orientation of the cells. (This lengthwise orientation of the cells follows the material elongation axis 50, as shown in FIG. 13.) At the same time, there is a moderate amount of outward bulging of the side surface portions 46U and 46L, so that the material thickness dimension $T_c$ increases to some extent. As the compressive load per unit area increases further, the wall segments 48 totally flatten out so that the lower valley lines 47L come closely adjacent to the underlying ground surface. When this occurs, the resistance of the pad to further compression increases substantially. However, the resistance provided as the pad compresses from its initial uncompressed position to the position where the main pad angle approaches a value close to 180 degrees is such that a desired cushioning effect is obtained, and this particular area or zone through which the pad compresses toward a totally horizontally aligned configuration can be termed a "comfort zone".

To analyze further the resistance provided by the pad of the present invention, let it be assumed that the pad angle $\delta$, with the pad in its unstressed position, is 90 degrees. Let us further assume an idealized situation where as a downward compressive force is applied to an upper peak area 45U, the adjacent lower peak areas 45L do not shift laterally. Under these conditions, for a downward incremental unit of travel of that portion of the pad at the vertical plane extending from the upper peak 45U to the valley line 47L immediately below, each of the adjacent wall segments 48 compress along their respective alignment planes by a value equal to about 0.7 of the incremental unit of downward travel. As the main pad angle increases to, for example, 120 degrees, then a further downward incremental unit of travel at the area of the upper peak 45U to the lower valley line 47L causes a further compression of the two pad segments 48 which is equal to 0.5 of the incremental unit of travel. As the main pad angle becomes yet larger, the amount of compression of the wall segments 48 decreases further.

However, there is another contributing factor, and this is that with greater downward deflection, the pad offers increased resistance in bending. It has been found that the resistance provided by the downward deflection of the pad of the present invention by the interaction of these forces is such that a very desirable programmed resistance to such downward deflection is achieved, with this following a desired comfort curve. There are quite likely other phenomena involved in the downward deflection resistance provided by this pad, and quite likely the above analysis is a somewhat simplified explanation. For example, there are likely other factors relating to the manner in which these forces are reacted at a cellular level, and there is the further consideration that the elongated cell configuration of the pad of the present invention enhances the interaction of the force reaction at the cellular level. In any event, regardless of the correctness of the above analyses and regardless of whether the above analyses may or may not be complete, it has been found that the pad of the present invention provides a relatively deep comfort zone, relative to the total depth of the pad, and that the resistance to the downward deflection provided by the pad occurs in a pattern which provides a relatively high comfort level.

From the above analysis, it can be recognized that within certain limits, the configuration of the pad can be optimized to maximize the depth of this comfort zone relative to the total depth dimension of the pad. To carry on with this analysis, there is a rib depth to total thickness ratio, with the total thickness or depth being the dimension $V_{pp}$, and with the rib depth $V_{rib}$ being the vertical d between the plane defined by the upper peak ridge lines 45U to the plane defined by the upper valley lines 47U or the vertical distance between the plane defined by the lower peak rib lines 45L and the plane defined by the lower valley lines 47L. Desirably, this ratio would be greater than 0.2, and more desirably between about 0.45 to 0.65. Preferred values would be between 0.55 and 0.57.

Related to this rib depth to total thickness dimension ratio is the minimum material thickness ($t_c$) to total thickness dimension $V_{pp}$ ratio. If this ratio is made too small, then the wa segments 48 will tend to buckle under compression, thus destroying the desired cushioning effect where the resistance increases along a more predictable curve. On the other hand, if this minimum material thickness to total thickness dimension ratio is made too large, then the pad allows smaller amount of downward deflection under compression, thus reducing the total depth of the comfort zone. The preferred minimum material thickness to total thickness ratio is desirably between about 0.2 to 0.7, and more desirably between about 0.3 to 0.6. Preferred values are between about 0.35 and 0.5.

It should also be recognized that by orienting the cells so that the lengthwise axis of the cells generally follows the material elongation axis 50, the cells become oriented so that the wall segments 48 are better able to resist bending (thus being more resistant to buckling), and also, it is believed, contributing to the overall effect of providing a proper comfort curve.

Having generally described the support pad 20 as well as the process for molding the support pad and the mold utilized in forming the support pad, the following examples are provided in order to describe the pad and the process for forming the pad in greater detail.

EXAMPLE 1.

Figure 9:
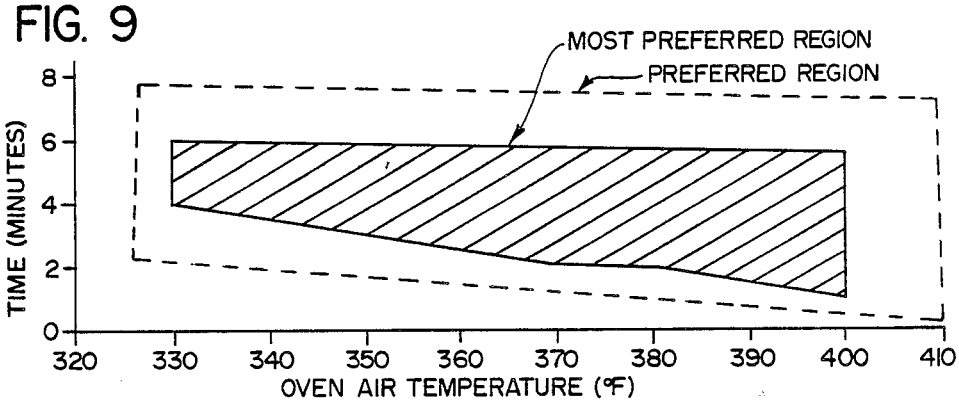
FIG. 9 is a graph showing preferred and most preferred envelopes of heating times and temperatures of a workpiece which is thermoformed by the process of the present invention.

A workpiece made of ethylene-vinyl acetate/-polyethylene copolymer (EVA) foam known as Trocellen XD 200, manufactured by Dynamit-Noble, and having the approximate dimensions somewhat greater than forty eight inches by twenty inches with a thickness dimension of one half inch, was provided. This workpiece had a rectangular configuration with planar upper and lower surfaces A conventional commercial convection oven was heated to the desired temperature and the workpiece was placed in the oven and heated at 350° F. for four minutes. Preferred and most preferred ranges of temperatures and heating time are shown in the graph of FIG. 9. After being heated, the workpiece was removed from the oven by hand, and placed on the lower mold 94 of a conventional four post press with at least a 10 psi compression capability over the area of the workpiece. The mold minimum ridge to ridge distance, $D_{CLOS}$ was 0.02 inches; this interval being set by stop blocks between the moving upper platen and static lower platen of the press.

The prototype mold upper portions and mold lower portions were made from maple wood. The dimensions of the upper and lower mold portions were approximately as follows:

$\alpha=\alpha'=68°$ $V_{mold}=0.50$ inches $W_P=0.02$ inch $W_G=0.001$ inch

The heated workpiece was loaded from the oven into the press as expeditiously as possible, and the press immediately closed. Preferred oven to press times were from ten to fifteen seconds, with thirty to forty seconds being the maximum. The press remained closed for about sixty seconds, and then opened and the formed pad removed.

The formed pad had a slightly different configuration than the mold itself. More particularly, the angle $\gamma$ of the rib sidewalls was about eighty degrees $\pm 3$ degrees, with the ribs being somewhat rounded and having a radius of about 11/64 inch. The valleys of the pad formed an angle $\gamma$ of about eighty $\pm 3$ degrees, with the sidewalls of the valleys forming a sharp angle at the valley lines. The rounded configuration of the ribs was due to the inherent resistance of the polymer material to flow completely into, and remain in, the grooves of the mold during compression. The minimum pad thickness $t_c$ was about 0.32 inch, resulting in a vertical dimension through the rib walls of 0.45 inch. The formed pad had a smooth, continuously formed skin along the ribs and valleys with no bubbles observed in the valleys and no burst through along the ribs.

EXAMPLE 2

Having formed the pad in the manner described in Example 1, the resistance to tear of the pad valleys was measured. This test was performed by first determining the tear strength of the unmolded workpiece of Example 1, by initiating a tear through about 50% of the width of the workpiece and then anchoring one tear section to a wall and attaching a force gauge to the other tear section. By manually pulling on the force gauge the tear was continued at a rate of about twenty inches per minute until the two sections were torn in two. The average force was measured during the tear. Four samples were tested in this manner which resulted in an average tear resistance of 4.88 (standard deviation=0.52) pounds or an average tear resistance of 9.38 (standard deviation=1.00) pounds per inch of pad thickness.

For comparison, six support pads manufactured in accordance with the process of Example 1 were tested in the same manner. A tear was initiated along the length of 50% of a valley line before attaching the load gauge. An average tear resistance of 5.3 (standard deviation=1.05) pounds or a tear resistance of 14.5 (standard deviation=2.84) pounds per inch of pad thickness was measured. None of the tears remained in the valley lines.

These comparison tests not only showed the improved overall strength of the support pads produced by the process of the present invention, but the portion of the pad most resistant to tear was along the valley lines.

As discussed previously, a small mold ridge plateau width $W_P$ is important in avoiding unwanted degradation of the pad. This is illustrated by the following examples in which a mold having a large ridge plateau width was utilized.

EXAMPLE 3

A 12 inch×12 inch×0.7 inch workpiece of two ply laminated EVA foam Trocellen XD 200 was molded by an upper mold having the following dimensions.

Design #153

$W_P$=0.2 inches
$W_G$=0.001 inch
$\alpha=\alpha'=54°$
$V_{mold}$=0.6 inches

The lower mold had a flat surface such that only one side of the pad was molded. The molding process was performed in accordance with the steps of Example 1, except that the mold was used to form a minimum pad thickness of 0.1 inches at the valleys. The formed pad upon removal from the mold had bubbles which formed beneath the skin along the pad valleys. These bubbles were believed to be caused by gases which had been displaced from the ruptured cells of the foam by the molding process.

Also discussed previously was the increased insulation provided by the pockets at the upper and lower surfaces of the pad. This increased thermal insulation was verified in the following example.

EXAMPLE 4

A six inch by six inch by six inch block of ice was removed from the freezer of a refrigerator, and placed in an insulated chest. The foam pad under test, a six inch by six inch by one half inch piece of a closed cell foam material having flat upper and lower surfaces was placed on top of the ice block and a one inch thick sleeping bag section of polyester batting contained between two nylon sheets was compressed on the surface of the pad by 0.5 psi to simulate body load. A thermocouple was placed between the sleeping bag section and a piece of urethane foam insulation having a thickness dimension of twelve inches. The temperature indicated on the thermometer was recorded as a function of elapsed time and displayed on a graph in FIG. 10.

Figure 10:
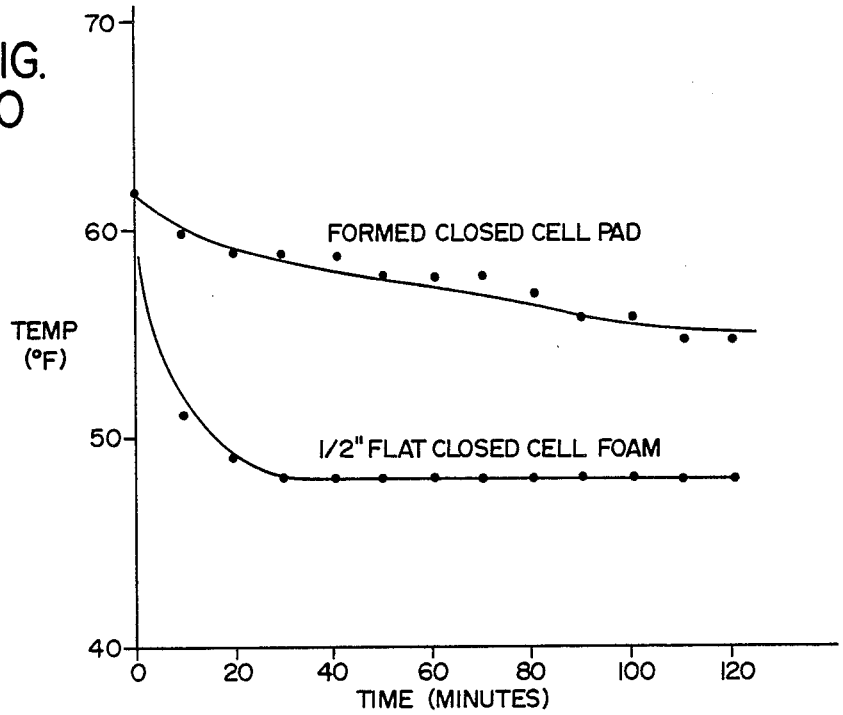
FIG. 10 is a graph of temperature as a function of time for both an unformed closed cell foam workpiece and the formed pad of the present invention, to illustrate the thermal insulation properties of the formed pad.

To determine the thermal insulating properties of the support pad of the present invention, a support pad formed from a six inch by six inch by one half inch piece of workpiece by the process of Example 1 was tested in the aforementioned manner and the temperature as a function of elapsed time was recorded on the graph of FIG. 10. It is clear from the graph that the support pad of the present invention has superior thermal insulating properties to a one half inch thick closed cell pad having substantially flat upper and lower surfaces.

EXAMPLE 5

Figure 12:
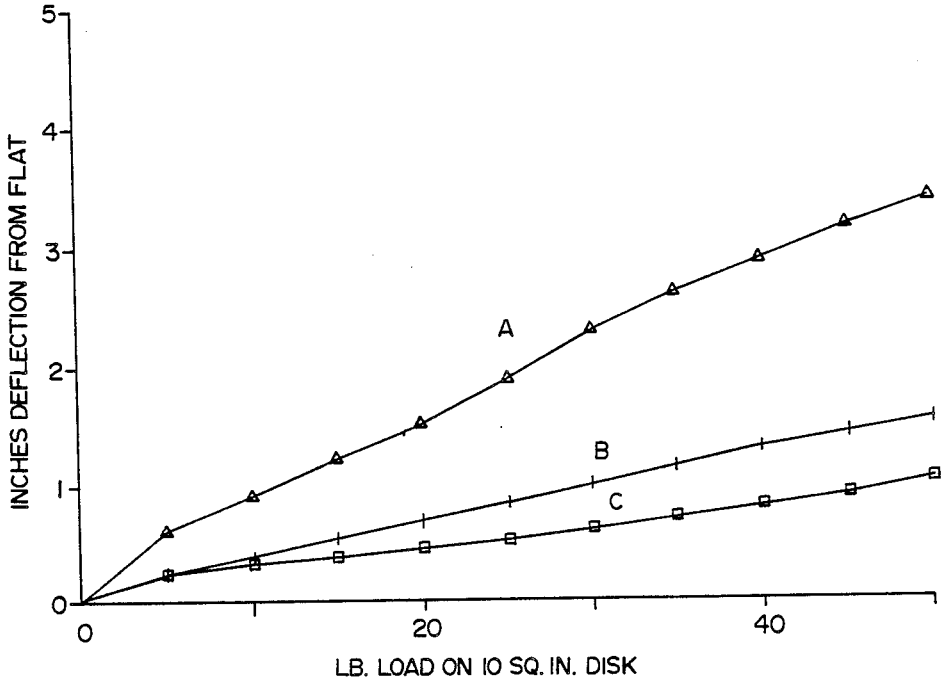
FIG. 12 is a graph of deflection as a function of loading for the support pad of the present invention and for two conventional support pads.

To verify a significant increase in compliance of the present invention over a typical unformed closed cell foam pad, deflection versus load measurements were taken. The pad under test was deflected a known amount by pushing a ten square inch circular disc into it; the greater the deflection caused by a given load, the more compliant the pad. The force was then measured with a force gauge; deflection in inches being plotted as a function of force in pounds in FIG. 12. A pad formed by the procedures set forth in Example 1 was measured in this manner and the data plotted in FIG. 12 as a curve designated by the letter A. Curve B in FIG. 12 shows the deflection versus load measurements for an unmolded one half inch thick piece of Trocellen XD 200. Finally, curve C shows the deflection versus load measurements for a conventional flat closed cell ethylene/vinyl acetate copolymer foam ground pad known as BEVALITE. The deflection measurements of the formed pad, as shown by curve A, as compared to the unformed pads, as shown by curves B or C, illustrate the greater compliance of the formed pad of the present invention.

A second embodiment of the present invention is illustrated in FIG. 19. There is a pad 200 made of a closed cell polymer foam material, as in the first embodiment. The pad 200 has a planar lower surface 202, and an upper surface 204 formed with a plurality of elongate ribs 206, with each adjacent pair of ribs 206 defining related valleys 208. Each rib 206 is formed by two substantially planar sidewall portions 210 which extend upwardly toward one another to a rounded peak rib area 212. The sidewall portions 210 from adjacent ribs 206 that form the related valley 208 meet at a valley line area 213.

The pad 200 of the second embodiment is thermoformed in substantially that same manner as in the first embodiment, except that one of the molds has a planar surface so that the ribs 206 are formed only on one side. In the thermoforming operation, the cells of the material making up the pad 200 become elongated in a direction having an alignment component transverse to lengthwise axes of the ribs 206. Thus the valley line areas 213 are formed in such a manner that, as in the first embodiment, there is a relatively high resistance to tear at the valley line areas 213.

With regard to the preferred dimensions of the pad 200, the total vertical depth or thickness dimension $V_t$ is desirably between about 0.3 to 1.5 inches, more desirably between about 0.5 to 1.0 inches, and preferably about 0.7 inch. The peak-to-peak spacing distance $H_{pp}$ (measured between peak center lines 214 of adjacent peaks) is less than about 3 inches, preferably less than about 1¼ inches, and in the preferred embodiment about ¾ of an inch.

The ratio of the total thickness dimension to the peak-to-peak dimension is desirably between about 0.6 to 1.4, more desirably between about 0.7 to 1.3 and in the preferred form about 0.8 to 1.2.

It should be noted that in this text when a ratio is expressed as a single numerical value, the ratio is understood to be the ratio of that numerical value to one. For example, when it is stated that the ratio of the total thickness dimension to the peak-to-peak dimension is desirably between about 0.6 to 1.4, this is understood to mean that the ratio is between about 0.6 to 1 and 1.4 to 1. This same procedure is followed elswhere in this text.

There is also a rib height dimension $V_r$ which is the vertical dimension between a plane occupied by the peak portions 212 to a plane occupied by the valley line areas 213. This rib height dimension is desirably between about 0.2 to 1.1 inch, more desirably between about 0.3 to 0.6 inch, and in the preferred form between about 0.35 and 0.5 inch. The ratio of the rib height $V_r$ to the total thickness dimension $V_t$ is desirably between about 0.3 to 0.8, more desirably between about 0.4 to 0.75, and in the preferred form about 0.5 to 0.7.

As in the first embodiment, the sidewall surface portions 210 are slanted, with the sidewall portions 210 of each rib meeting at a pad angle m. Desirably the pad angle m is between about 60 to 130 degrees, more preferably between about 65 to 105 degrees, and in the preferred form between about 70 and 90 degrees.

While the second embodiment of FIG. 19 does not offer all of the advantages of the first embodiment, it does provide a good deal of comfort to the user, and also some of the functional benefits of present invention.

A third embodiment of the present invention is illustrated in FIG. 20. Components of this third embodiment which are similar to components of the second embodiment will be given like numerical designations, with a prime (') designation distinguishing those of the third embodiment.

The pad 200' of the third embodiment of FIG. 20 is similar to the first embodiment except that in addition to having the top surface 204' formed with upper ribs 206U', the bottom surface 202' is also formed with lower ribs 206L'. Each upper rib 206U' is vertically aligned with a related lower rib 204L', and the upper valley area lines 212U' are vertically aligned with related lower valley area lines 213L'.

The pad 200' of the third embodiment is thermoformed in substantially the same way as the pad of the first embodiment except that in this third embodiment, the ribs of the mold are vertically aligned with one another.

The total thickness dimension $V_{pp}$ is preferably between about 0.3 inches to 1.5 inches, more preferably between about 0.5 inches to 1.0 inches, and most preferably about 0.7 inches. The peak-to-peak spacing distance $H_{pp}$ is preferably less than about 3 inches, more preferably less than about 1.25 inches, and the most preferred dimension is about $\frac{3}{4}$ inches. The rib height $V_r$ is preferably less than about $\frac{3}{4}$ inches, more preferably less than about $\frac{5}{8}$ inches, and most preferably less than about $\frac{3}{8}$ inches.

The sidewall portions 210' of each upper rib 206U' converge upWardly, and a preferred pad angle m' is between about 60 to 130 degrees, more preferably between about 65 to 105 degrees, with a most preferred range being between about 70 and 90 degrees.

The total thickness dimension to peak-to-peak ratio ($V_{pp}/H_{pp}$) is desirably between about 0.4 and 2, more desirably between about two thirds and four thirds with a most preferred ratio being between about 0.8 and 1.1. There is also a rib height ($V_r$) to total thickness dimension ($V_{pp}$) ratio, and this is preferably between about 0.1 an 0.45, more preferably between about 0.15 and 0.45, with a preferred ratio being between about 0.2 and 0.4.

As with the second embodiment, while this third embodiment does not incorporate all the advantages of the preferred first embodiment, it has been found that the pad 200' of this third embodiment does provide relatively good comfort, while having certain functional advantages of the first embodiment.

A fourth embodiment of the present invention is illustrated in FIGS. 21 and 22. There is a pad 220 which is formed with a closed cell foam polymer material. However, instead of forming the upper and lower surfaces 222 and 224 with elongate ribs, in this fourth embodiment, the upper and lower surfaces are formed with upper and lower protrusions 226 and 228, respectively.

Each of the upper protrusions 226 has the overall configuration of a cone, with a conically shaped side surface 230 and a rounded peak portion 232. The surface portion that is opposite each peak portion 232 is formed with a related recess 234 so that the material thickness $t_c$ of the pad 220 is, as much as possible, substantially uniform.

The angle "n" formed by the cone side surface 230 (i.e. this angle "n" being formed by the lines which are formed by the intersection of a plane coincident with the vertical center axis of the cone shape and intersecting the side wall 230) is preferably between about 60 to 130 degrees, and more preferably between 65 to 105 degrees. The ratio of the total depth dimension ($V_{pp}$) to the minimum peak spacing distance ($H_{pp}$) is desirably between about 0.4 and 2, and more preferably between about two thirds and four thirds. Further, it has been found that the ratio of the minimum pad thickness to total depth dimension is preferably between about 0.2 and 0.7, more preferably between about 0.3 and 0.6 with ratios between about 0.35 and 0.5 being most preferred.

The method of forming the pad 220 of this fourth embodiment is generally the same as described with reference to the first embodiment, in that this is accomplished by thermoforming between two molds contoured to properly form the protrusions and recesses. The cellular structure of the closed cell foam material is stretched so that the cells become elongated in a direction generally paralleling the contours of the surfaces of the pad 220. While this fourth embodiment does not provide all of the advantages of the first embodiment, this pad of the fourth embodiment (shown in FIGS. 21 and 22) does provide a relatively high degree of comfort and does incorporate some of the functional benefits of the present invention.

While the slanted side surfaces 230 are shown to be cone shaped, obviously the surface configuration could be varied within reasonable limits from an ideal conical configuration. Further, in all embodiments and variations described herein, it is understood that, due to the nature of the forming process, the peaks of the ribs will not be sharp, but rather, will have radii. It is natural and conceivable that many of the preferred embodiments could have ribs with more nearly full radii in cross-section.

A fifth embodiment of the present invention is illustrated in FIGS. 23 and 24. There is a pad 300 made of a closed cell polymer foam material, as in the prior embodiments. The pad 300 has a lower planar surface 302, and an upper surface 304 formed with a plurality of protrusions 306. In the preferred form, these protrusions are each formed with an upwardly tapering conically shaped side surface 308 and a rounded top surface 310. While this is the preferred shape, obviously, the surface contour can be varied to some extent.

The pad angle "p" formed by the side surfaces 308 (i.e. this angle "P" being formed by the lines which are formed by the intersection of a plane coincident with the vertical center axis of the cone shape and intersecting the side wall 308) is preferably between about 10 to 120 degrees, and more preferably between 30 to 90 degrees. Also, the pad 300 has a total vertical thickness dimension $V_t$, and also a peak-to-peak distance $H_{pp}$, which is the distance between vertical center lines of adjacent protrusions. The ratio of the total thickness dimension to the peak-to-peak dimension is desirably between about 0.4 to 2, with a more preferred ratio range being between 2 to 3 and 4 to 3.

The pad 300 has a material thickness dimension $t_c$ which, as illustrated in FIG. 23, is the minimum distance between the upper surface 304 and the lower surface 302. The ratio of the material thickness dimension to the total thickness dimension is desirably between about 0.2 to 0.7, more preferably between about 0.3 to 0.6, and most preferably between 0.35 and 0.5.

While this fifth embodiment of FIGS. 23 and 24 does not offer all of the advantages of the first embodiment, it does provide a good deal of comfort to the user, and also some of the functional benefits of the present invention.

A sixth embodiment is illustrated in FIGS. 25 and 26, where there is shown a pad 400 having a lower surface 402 and an upper surface 404. Both of these surfaces 402 and 404 are formed with a plurality of protrusions, with each upper protrusion 406U being vertically aligned with a matching lower protrusion 406L. These protrusions 406U and 406L are shaped substantially the same as the protrusions 306 Of the fifth embodiment, except that the dimensions of these protrusions 406 are made smaller for a given total pad thickness The pad angle p for the protrusions 406 fall in the same ranges as the pad angles for the fifth embodiment. Also, the ranges for the ratio of the total thickness dimension to the peak-to-peak dimension, as well as the ranges for the material thickness to the total thickness dimension ratio are substantially the same as in the fifth embodiment.

The pads 300 and 400 of the fifth and sixth embodiments are thermoformed from a closed cell foam in generally the same manner as described previously.

Common to the six embodiments previously mentioned is a comfort-related requirement which balances overall compliance with local pad morphology. As the horizontal peak-to-peak spacing is increased, all else being equal, the user will become more aware of the individual protrusions. Within the present invention, the ratio of the horizontal spacing of pad protrusions to the height of those protrusions (relative to adjacent valleys) is a useful design parameter. Specifically, it is preferred that this ratio be between about 0.9 and 4.3, more preferably between about 1.3 and 2.7, and most preferably between 1.4 and 2.5.

It is to be understood that various modifications could be made to the products and methods of the present invention without departing from the basic teachings thereof.

Also it is to be understood that the terms "upper" and "lower" are not intended to be limiting so as to mean that the upper portion of a pad is always positioned upwardly. On the contrary, what is designated as the "upper" area or portion could in actual use be placed at a lower location so as to be against an underlying support surface.

What is claimed is:

1. A flexible pad for supporting a load above an underlying surface, the pad having an upper surface a lower surface, a first horizontal axis, a second horizontal axis perpendicular to the first axis, and a vertical axis, a. said pad being characterized in that it is thermoformed from a workpiece of a closed cell foam material which comprises a plurality of closed cells, having an initial cellular configuration, said cells being elongated from said initial configuration in a direction of elongation and being compressed from said initial configuration in a direction substantially perpendicular to the direction of elongation of said cells, with this being accomplished by application of compressive forces against upper and lower surfaces of said workpiece;

b. said upper surface being formed with a plurality of elongate upper ribs and valleys with each rib having first and second upper side surface portions which slant upwardly in directions of slant toward one another to a peak area of said rib, and with each valley being defined by the first upper side surface portion of one rib and by the second upper side surface portion of another rib adjacent to said one rib and meeting the side surface portion of said one rib at an upper valley line area, with cells beneath to said first and second upper side surface portions being elongated generally parallel to said directions of slant of said first and second upper side surface portions;

c. the first and second side surface portions of each rib being characterized in that first and second planes occupied by the first and second side surface portions of each rib meet at a pad angle which is between the 60 degrees and 130 degrees;

d. said pad being further characterized in that there is an upper peak to peak distance which is measured from a center line of one peak area of one rib to a center line of another peak area of said other rib which is adjacent to said one rib, each rib having an upper rib depth dimension which is a vertical distance between a peak area of he upper rib to the valley line area of an adjacent upper valley, with a ratio of said upper peak to peak distance to said upper rib depth dimension being between about 0.9 and 4.3.

2. The pad as recited in claim 1 wherein a. said lower surface has a plurality of lower ribs and lower valleys, with each lower rib having first and second lower side surface portions which slant downwardly toward one another in directions of slant to a lower peak area of said lower rib, and with each lower valley being formed by the first lower side surface portion of one lower rib and the second lower side surface portion of another lower rib adjacent to said one lower rib and meeting said one lower rib at a lower valley line area, with cells above said lower side surface portions being elongated generally parallel to said directions of slant of said first and second lower side surface portions, b. the first and second lower surface portions of each lower rib being characterized in that first and second planes occupied by the first and second surface portions of each lower rib meet at a lower pad angle which is between about 60 degrees and 130 degrees;

c. said pad being further characterized in that there is a lower peak to peak distance which is measured to a center line of one peak area of said one lower rib to a center line of another peak area of said other lower rib which is adjacent to said one lower rib, each lower rib having a lower rib depth dimension which is a vertical distance between a lower peak area of the lower rib to the valley line area of an adjacent lower valley, with a ratio of said lower peak to peak distance to said lower rib depth dimension being between about 0.9 and 4.3.

3. The pad as recited in claim 2 wherein each of the upper pad angles and each of the lower pad angles is between about 65 and 105 degrees.

4. The pad as recited in claim 3 wherein the ratio of the upper peak to peak distance to the upper rib depth dimension and also the ratio of lower peak to peak distance to the lower rib depth dimension are between about 1.3 and 2.7.

5. The pad as recited in claim 3, wherein the lower pad angle and the upper pad angle are each between about 70 and 90 degrees.

6. The pad as recited in claim 5, wherein the ratio of the upper peak to peak distance to the upper rib depth dimension and the ratio of the lower peak to peak distance to the lower rib depth dimension are each between about 1.4 and 2.5.

7. The pad as recited in claim 1, wherein said pad angle is between about 65 and 105 degrees.

8. The pad as recited in claim 7, wherein the ratio of peak to peak distance to the rib depth dimension is between about 1.3 and 2.7.

9. The pad as recited in claim 7, wherein the rib angle is between about 70 and 90 degrees.

10. The pad as recited in claim 9, wherein the ratio of the peak to peak distance to the rib depth dimension is between about 1.4 and 2.5.

11. The pad as recited in claim 1, wherein said lower surface is substantially planar, and said pad has a total depth dimension which is equal to a distance from a plane passing through said peak areas to said lower surface, with a ratio of said rib depth dimension to said total thickness dimension being between about 0.3 and 0.8.

12. The pad as recited in claim 11, wherein the ratio of the rib depth dimension to the total thickness dimension is between about 0.4 and 0.7.

13. The pad as recited in claim 11, wherein the pad angle is between about 65 and 105 degrees.

14. The pad as recited in claim 13, wherein the ratio of the peak to peak distance to said rib depth dimension is between about 1.3 and 2.7.

15. The pad as recited in claim 12, wherein said rib dimension is between about 0.2 and 1.1 inches.

16. The pad as recited in claim 15, wherein the ratio of peak to peak distance to the rib depth dimension is between about 1.4 and 2.5.

17. A flexible pad for supporting a load above an underlying surface, the pad having an upper surface, a lower surface, a first horizontal axis a second horizontal axis perpendicular to the first axis, and a vertical axis, a. each of said upper and lower surfaces being formed with a plurality of upper and lower ribs respectively, and with upper and lower valleys, respectively, and with the upper ribs being offset from the lower ribs in a manner that the upper ribs are vertically aligned with the lower valleys and the lower ribs are vertically aligned with the upper valleys, each of the upper ribs having upper side surface portions which slant in directions of upward slant upwardly toward one another to an upper peak area of said upper rib, each of said lower ribs having lower side surface portions which slant downwardly toward one another in directions of downward slant to a lower peak area of said lower rib, each upper valley being formed by adjacent side surface portions of adjacent upper ribs which meet a related upper valley line area, each lower valley being formed by adjacent side surface portions of adjacent lower ribs which meet at a related lower valley line area;

b. each upper side surface portion being generally aligned with an adjacent lower side surface portion to form a related wall segment of said pad with each wall segment having a material thickness dimension between its upper and lower side surface portions, each wall segment joining at upper and lower edges thereof to upper and lower edges, respectively, of adjacent wall segments, with each wall segment having an alignment plane centered between the upper and lower surfaces defining that wall segment, the alignment planes of adjacent wall segments meeting each other at a pad angle;

c. said pad having a total thickness dimension which is equal to a vertical distance between a horizontal plane defined by the upper peak areas and a horizontal plane defined by the lower peak areas;

d. said pad having a peak o peak distance which is equal to a distance between center lines of adjacent upper peak areas or between center lines of adjacent lower peak areas;

e. said pad having a rib depth dimension which is equal to a vertical distance between the plane defined by the upper rib peak areas to a plane defined by the upper valley line areas or a vertical distance between the plane defined by the lower rib peak areas and a plane defined by the lower valley line areas;

f. said pad having a total unit cross-sectional area which is equal to a value obtained by multiplying the peak to peak dimension times the total depth dimension, and having a normalized unit area equal to a total cross-sectional area of a unit of the pad measured from a vertical plane passing through the center line of the upper peak area to a vertical plane passing through the center line of an adjacent peak area, along a vertical plane perpendicular to the center lines of the peak areas of the said one peak and said adjacent peak, the pad having a normalized area ratio which is the ratio between the normalized unit area to the total unit cross-sectional area;

g. said pad being characterized in that it is thermoformed from a workpiece of closed cell polymer foam material having an initial cellular configuration, and having an initial forming axis along which said workpiece is stretched by thermoforming, said pad having a material elongation axis which follows a zig zag line generally parallel to the directions of upward slant of the upper side surface portion and also parallel to the directions of downward slant of said lower side surface portions and which is generally aligned with said forming axis, said pad having a material elongation ratio which is the ratio of the length of the material elongation axis extending through an area of the pad having the ribs and valleys to the length of the forming axis of the workpiece through an area of the workpiece formed with the ribs and valleys, said pad being characterized in that the cells of the pad are elongated in directions of elongation generally parallel to said material elongation axis, and the cells are compressed in directions substantially perpendicular to said material elongation axis, with compression and elongation of the cells being accomplished by application of compressive forces against upper and lower surface of said workpiece.

18. The pad as recited in claim 17, wherein said pad angle is between about 60 to 130 degrees.

19. The pad as recited in claim 18, wherein said pad angle is between about 65 to 105 degrees.

20. The pad as recited in claim 18, Wherein said pad angle is between about 70 and 90 degrees.

21. The pad as recited in claim 17, wherein the ratio of the material thickness dimension to the total thickness dimension is between about 0.2 and 0.7.

22. The pad as recited in claim 21 wherein the ratio of the material thickness dimension to the total thickness dimension is between about 0.3 and 0.6.

23. The pad as recited in claim 21, wherein the ratio of the material thickness dimension to the total thickness dimension is about 0.35 and 0.5.

24. The pad as recited in claim 17, wherein the ratio of the peak to peak dimension to the rib depth dimension is between about 0.9 and 4.3.

25. The pad as recited in claim 24, wherein the ratio of the peak to peak dimension to the rib depth dimension is between about 1.3 and 2.7.

26. The pad as recited in claim 24, wherein the ratio of the peak to peak dimension to the rib depth dimension is between about 1.4 and 2.5.

27. The pad as recited in claim 17, wherein the normalized area ratio is between about 0.3 and 0.8.

28. The pad as recited in claim 27, wherein the normalized area ratio is between about 0.5 and 0.75.

29. The pad as recited in claim 27, wherein the normalized ratio is between about 0.6 and 0.7.

30. The pad as recited in claim 17 wherein the material elongation ratio is between about 1.05 and 2.2.

31. The pad as recited in claim 30, wherein the material elongation ratio is between about 1.1 and 1.6.

32. The pad as recited in claim 30, wherein the material elongation ratio is about 1.3.

33. The pad as recited in claim 17, wherein
a. the pad angle is between about 60 degrees and 130 degrees;
b. the ratio of the material thickness dimension to the total thickness dimension is about 0.2 and 0.7.

34. The pad as recited in claim 33, wherein
a. the pad angle is between about 65 and 105 degrees;
b. the ratio of the material thickness dimension to the total thickness dimension is about 0.3 and 0.6.

35. The pad as recited in claim 33, wherein
a. the pad angle is between about 70 and 90 degrees;
b. the ratio of the material thickness dimension to the total thickness dimension is about 0.35 and 0.5.

36. The pad as recited in claim 17, wherein
a. the ratio of the peak to peak dimension to the rib depth dimension is about 0.9 and 4.3;
b. the normalized area ratio is between about 0.3 and 0.8;
c. the material elongation ratio is between about 1.05 and 2.2.

37. The pad as recited in claim 36, wherein
a. the ratio of the peak to peak dimension to the rib depth dimension is about 1.3 and 2.7;
b. the normalized area ratio is between about 0.5 and 0.75;
c. the material elongation ratio is between about 1.1 and 1.6.

38. The pad as recited in claim 36, wherein
a. the ratio of the peak to peak dimension to the rib depth dimension is between about 1.4 and 2.5;
b. the normalized area ratio is between about 0.6 and 0.7;
c. the material elongation ratio is about 1.3.

39. The pad as recited in claim 17, wherein
a. the pad angle is between about 60 to 130 degrees;
b. the ratio of the material thickness dimension to the total thickness dimension is between about 0.2 and 0.7;
c. the ratio of the peak to peak dimension to the rib depth dimension is between about 0.9 and 4.3;
d. the normalized area ratio is between about 0.3 and 0.8;
e. the material elongation ratio is between about 1.05 and 2.2.

40. The pad as recited in claim 39, wherein
a. the pad angle is between about 65 and 105 degrees;
b. the ratio of the material thickness dimension to the total thickness dimension is between about 0.3 and 0.6;
c. the ratio of the peak to peak dimension to the rib depth dimension is between about 1.3 and 2.7;
d. the normalized area ratio is about 0.5 and 0.75;
e. the material elongation ratio is between about 1.1 and 1.6.

41. The pad as recited in claim 39, wherein
a. the pad angle is between about 70 and 90 degrees;
b. the ratio of the material thickness dimension to the total thickness dimension is about 0.35 and 0.5;
c. the ratio of the peak to peak dimension to the rib depth dimension is about 1.4 and 2.5;
d. the normalized area ratio is between about 0.6 and 0.7;
e. the material elongation ratio is about 1.3.

42. A flexible pad for supporting a load above an underlying surface, the pad having an upper surface a lower surface, a first horizontal axis a second horizontal axis perpendicular to the first axis and a vertical axis;
a. said upper and lower surfaces being formed with a plurality of upper and lower outwardly extending protrusions, respectively, and with upper and lower recesses positioned between their respective protrusions, the upper protrusions being horizontally offset relative to the lower protrusions, in a manner that the upper protrusions are vertically aligned with the lower recesses, and the lower protrusions are vertically aligned with the upper recesses, each of said upper protrusions having an upper side surface which slopes upwardly and convergently toward an upper peak area, and each of said lower protrusions having a lower side surface which slopes downwardly and convergently toward a related lower peak area;
b. said pad being characterized in that it is thermoformed from a workpiece of a closed cell foam material which comprises a plurality of closed cells having an initial cellular configuration, in a direction generally perpendicular to adjacent surface portions of the upper and lower surface, and with the cells being elongated by being compressed from said initial configuration in a direction generally parallel to adjacent surface areas of the upper and lower surfaces with axis of elongation of the cells being generally parallel to directions in which the material is stretched during a thermoforming operation by which the pad is made;
c. said pad has a total thickness dimension which is equal to a vertical distance between a horizontal plane defined by the upper peak areas and a horizontal plane defined by the lower peak areas;
d. said pad has a peak to peak distance which is equal to a distance between center locations of adjacent upper peak areas or between center locations of adjacent lower peak areas;
e. said pad has a total unit cross-sectional area which is equal to a value obtained by multiplying the peak to peak dimension times the total depth dimension, and having a normalized unit area equal to a total cross-sectional area if a unit of the pad measured from a first vertical line passing through the center location of one peak area to a second vertical line of a center location of an adjacent peak area, with the cross-sectional area being taken on a plane defined by said first and second vertical lines, the pad having a normalized area ratio which is the ratio between the normalized unit area to the total unit cross-sectional area.

43. The pad as recited in claim 42, wherein said normalized area ratio is between about 0.3 and 0.8.

44. The pad as recited in claim 43, wherein said normalized area ratio is between about 0.5 and 0.75.

45. The pad as recited in claim 42, wherein said upper side surfaces which define said upper protrusions slant upwardly relative to said vertical axis at a pad angle between about 60 and 130 degrees.

46. The pad as recited in claim 45, wherein said pad angle is between about 65 and 105 degrees.

47. The pad as recited in claim 42, wherein the ratio of said total thickness dimension to said peak to peak spacing distance is between about 0.4 and 2.

48. The pad as recited in claim 47, wherein said ratio of the total thickness dimension to the peak to peak spacing distance is between about $\frac{2}{3}$ and 4/3.

49. The pad as recited in claim 42, wherein a. the normalized area ratio is between about 0.3 and 0.8.

b. said upper side surfaces which define said upper protrusions slant upwardly relative to said vertical axis at a pad angle between about 60 and 130;

c. peak areas of adjacent protrusions have a peak to peak spacing distance, with a ratio of said total thickness dimension to said peak to peak spacing distance being between about 0.4 and 2.

50. The pad as recited in claim 49, wherein a. said normalized area ratio is between about 0.5 and 0.75;

b. said pad angle is about 65 and 105 degrees;

c. said ratio of the total thickness dimension to the peak to peak spacing distance is between about $\frac{2}{3}$ and 4/3.

51. A flexible pad for supporting a load above an underlying surface, the pad having an upper surface, a lower surface, a first horizontal axis a second horizontal axis perpendicular to the first axis, and a vertical axis, a. said upper surface being formed with a plurality of upper upwardly extending protrusions, separated by upper recesses positioned between their respective protrusions, each of said upper protrusions having an upper side surface which slopes upwardly and convergently toward an upper peak area, opposite surface portions of each of said side surfaces extending upwardly toward one another at a pad angle between about 10 degrees and 130 degrees;

b. said pad being characterized in that it is thermoformed from a workpiece of a closed cell foam material which comprises a plurality of closed cells having an initial cellular configuration, said cells compressed by thermoforming in a direction generally perpendicular to adjacent upper surface portions of the upper surface, and with the cells being elongated in a direction generally parallel to adjacent surface portions of the upper and lower surfaces with axes of elongation of the cells being generally parallel to directions in which the material is stretched during said thermoforming by which the pad is made.

52. The pad as recited in claim 51, wherein said pad angle is between about 30 degrees and 90 degrees.

53. The pad as recited in claim 31, wherein said pad has a total thickness dimension which is measured from a plane occupied by said upper peak areas to a lower plane defined by lower most portions of said lower surface of the pad, said pad also having a peak to peak dimension which is equal to a distance between center locations of adjacent peak areas of adjacent upper protrusions, said pad having a total thickness dimension to peak to peak ratio of between about 0.4 and 2.

54. The pad as recited in claim 52, wherein said total thickness dimension to peak to peak ratio is about 2 to 3 and 4 to 3.

55. The pad as recited in claim 51, wherein said pad has a material thickness dimension which is equal to a minimum distance between said upper and lower surfaces, said pad also having a total thickness dimension which is measured from an upper plane defined by said upper peak areas to a lower plane defined by lowermost portions of said lower surface, said pad having a material thickness dimension to total thickness dimension ratio which is between about 0.2 and 0.7.

56. The pad as recited in claim 55, wherein the ratio of the material thickness dimension to the total thickness dimension is between about 0.3 and 0.6.

57. The pad as recited in claim 55, wherein said ratio of the material thickness dimension to the total thickness dimension is between about 0.35 and 0.5.

58. The pad as recited in claim 51, wherein a. said pad has a total thickness dimension which is measured from a plane occupied by said upper peak areas to a lower plane defined by lower most portions of said lower surface of the pad, said pad also having a peak to peak dimension which is equal to a distance between center locations of adjacent peak areas of adjacent upper protrusions, said pad having a total thickness dimension to peak to peak ratio of between about 0.4 and 2;

b. said pad has a material thickness dimension which is equal to a minimum distance between said upper and lower surfaces, said pad also having a total thickness dimension which is measured from an upper plane defined by said upper peak areas to a lower plane defined by lowermost portions of said lower surface, said pad having a material thickness dimension to total thickness dimension ratio which is between about 0.2 and 0.7.

59. The pad as recited in claim 58, wherein a. said pad angle is between about 30 degrees and 90 degrees;

b. said total thickness dimension to peak to peak ratio is between about 2 to 3 and 4 to 3;

c. the ratio of the material thickness dimension to the total thickness dimension is between about 0.3 and 0.6.

60. The pad as recited in claim 51, wherein said lower surface is formed with a plurality of lower downwardly extending protrusions, separated by lower recesses positioned between their respective lower protrusions, each of said lower protrusions having a lower side surface which slopes downwardly and convergently toward a lower peak area, opposite surface portions of each of said side surfaces extending downwardly toward one another at a pad angle between about 10 degrees and 130 degrees.

61. The pad as recited in claim 60, wherein the pad angles are between about 30 degrees and 90 degrees.

62. The pad as recited in claim 60, wherein said pad has a total thickness dimension which is measured from a plane occupied by said upper peak areas to a lower plane defined by the lower peak areas, said pad also having a peak to peak dimension which is equal to a distance between center locations of adjacent peak areas of adjacent upper protrusions or equal to a distance between center locations of adjacent peak areas of lower protrusions, said pad having a total thickness dimension to peak-to-peak ratio of between about 0.4 and 2.

63. The pad as recited in claim 62, wherein said total thickness dimension to peak-to-peak ratio is between about 2 to 3 and 4 to 3.

64. The pad as recited in claim 60, wherein said pad has a material thickness dimension which is equal to a minimum distance between said upper and lower surfaces, said pad also having a total thickness dimension which is measured from an upper plane defined by said upper peak areas to a lower plane defined by the lower peak areas, said pad having a material thickness dimension to total thickness dimension ratio which is between about 0.2 and 0.7.

65. The pad as recited in claim 64, wherein the ratio of the material thickness dimension to the total thickness dimension is between about 0.3 to 0.6.

66. The pad as recited in claim 64, wherein the ratio of the material thickness dimension to the total thickness dimension is between about 0.35 and 0.5.

67. The pad as recited in claim 60, wherein a. said pad has a total thickness dimension which is measured from a plane occupied by said upper peak areas to a lower plane defined by the lower peak areas, said pad also having a peak-to-peak dimension which is equal to a distance between center locations of adjacent peak areas of adjacent upper protrusions or equal to a distance between center locations of adjacent peak areas of adjacent lower protrusions, said pad having a total thickness dimension to peak-to-peak ratio of between about 0.4 and 2;

b. said pad has a material thickness dimension which is equal to a minimum distance between said upper and lower surfaces, said pad also having a total thickness dimension which is measured from an upper plane defined by said upper peak areas to a lower plane defined by lowermost portions of said lower surface, said pad having a material thickness dimension to total thickness dimension ratio which is between about 0.2 and 0.7.

68. The pad as recited in claim 67, wherein a. the pad angles are between about 30 degrees and 90 degrees;

b. said total thickness dimension to peak-to-eak ratio is between about 2 to 3 and 4 to 3;

c. the ratio of the material thickness dimension to the total thickness dimension is between about 0.3 to 0.6.

* * * * *